US011493872B2

(12) United States Patent
Tanaka et al.

(10) Patent No.: US 11,493,872 B2
(45) Date of Patent: Nov. 8, 2022

(54) STATIC ELIMINATION DEVICE AND MEDIUM PROCESSING DEVICE USING THE SAME

(71) Applicant: FUJIFILM Business Innovation Corp., Tokyo (JP)

(72) Inventors: Hirotaka Tanaka, Kanagawa (JP); Koichiro Yuasa, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/928,091

(22) Filed: Jul. 14, 2020

(65) Prior Publication Data

US 2021/0216031 A1 Jul. 15, 2021

(30) Foreign Application Priority Data

Jan. 10, 2020 (JP) ..... JP2020-003005

(51) Int. Cl.
*G03G 15/00* (2006.01)
*G03G 21/08* (2006.01)
(Continued)

(52) U.S. Cl.
CPC ..... *G03G 15/6573* (2013.01); *G03G 15/1695* (2013.01); *G03G 15/5004* (2013.01); *G03G 15/5029* (2013.01); *G03G 15/657* (2013.01); *G03G 15/6535* (2013.01); *G03G 21/00* (2013.01); *G03G 21/06* (2013.01); *G03G 21/08* (2013.01); *G03G 2215/00426* (2013.01); *G03G 2215/00632* (2013.01); *G03G 2215/00649* (2013.01); *G03G 2215/00654* (2013.01); *G03G 2215/00767* (2013.01); *G03G 2221/00* (2013.01)

(58) Field of Classification Search
CPC .... G03G 15/1695; G03G 21/06; G03G 21/08; G03G 2215/00426; G03G 2215/00649; G03G 2215/00654; G03G 2215/00767; G03G 2215/00632; G03G 2221/00; G03G 15/5004; G03G 15/5029; G03G 15/6535; G03G 15/657; G03G 15/6573; G03G 21/00
See application file for complete search history.

(56) References Cited

U.S. PATENT DOCUMENTS 8,320,817 B2 11/2012 Zaretsky
2008/0317485 A1* 12/2008 Lee ..... G03G 15/1695 399/45

(Continued)

FOREIGN PATENT DOCUMENTS

JP 2016-157011 A 9/2016
JP 2017-111329 A 6/2017
JP 6481219 B2 2/2019

*Primary Examiner* — Joseph S Wong
(74) *Attorney, Agent, or Firm* — Sughrue Mion, PLLC

(57) ABSTRACT

A static elimination device includes: a first static elimination member that makes contact with a medium that is transported; a second static elimination member arranged such that the medium is inserted between the first static elimination member and the second static elimination member; and a power source that applies a voltage to at least one of the first static elimination member or the second static elimination member, in which at least one of the first static elimination member and the second static elimination member has an elastic body.

16 Claims, 33 Drawing Sheets

(51) Int. Cl.

| | |
|---|---|
| ***G03G 21/06*** | (2006.01) |
| ***G03G 15/16*** | (2006.01) |
| ***G03G 21/00*** | (2006.01) |

(56) References Cited

U.S. PATENT DOCUMENTS

| | | | | |
|---|---|---|---|---|
| 2009/0060618 | A1* | 3/2009 | Fujikura | B65H 43/00 399/407 |
| 2019/0107798 | A1* | 4/2019 | Miyamoto | G03G 15/5029 |

* cited by examiner

| | | CONTACT TYPE | NON-CONTACT TYPE |
|---|---|---|---|
| FRONT SURFACE RESISTANCE OF MEDIUM | HIGH RESISTANCE | ON | ON |
| | INTERMEDIATE RESISTANCE | OFF | ON |
| | LOW RESISTANCE | OFF | OFF |

FIG. 28A

| MEDIUM TRANSPORT SPEED v (mm/s) | FREQUENCY f (Hz) | f/v | EVALUATION RESULT |
|---|---|---|---|
| 1000 | 1500 | 1.5 | ○ |
| 1000 | 2000 | 2 | ○ |
| 1000 | 1000 | 1 | ○- |
| 1000 | 800 | 0.8 | ○- |
| 1000 | 100 | 0.1 | × |
| 182 | 100 | 0.55 | × |
| 455 | 100 | 0.22 | × |

FIG. 28B

| MEDIUM TRANSPORT SPEED (mm/S) | HOUSING OPENING WIDTH | | |
|---|---|---|---|
| | 10 mm | 20 mm | 30 mm |
| 1000 | 3000 Hz | 1800 | 1080 |

FIG. 28C

| MEDIUM TRANSPORT SPEED (mm/S) | HOUSING OPENING WIDTH | | |
|---|---|---|---|
| | 10 mm | 20 mm | 30 mm |
| 1000 | 3 | 1.8 | 1.08 |

FIG. 28D

| MEDIUM TRANSPORT SPEED (mm/S) | HOUSING OPENING WIDTH | | |
|---|---|---|---|
| | 10 mm | 20 mm | 30 mm |
| 1000 | 30 | 36 | 32.4 |

STATIC ELIMINATION DEVICE AND MEDIUM PROCESSING DEVICE USING THE SAME

CROSS-REFERENCE TO RELATED APPLICATIONS

This application is based on and claims priority under 35 USC 119 from Japanese Patent Application No. 2020-003005 filed Jan. 10, 2020.

BACKGROUND

(i) Technical Field

The present disclosure relates to a static elimination device that eliminates static from a medium, and a medium processing device using the static elimination device.

(ii) Related Art

The devices described in the patent documents below, for example, are already conventionally known as static elimination devices of this kind.

Japanese Unexamined Patent Application Publication No. 2016-157011 discloses an image forming system having, in order to suppress mediums sticking to each other: a charge control unit that charges a medium on which an image has been formed by an image forming unit; and an applied current controller that controls the current supplied to the charge control unit, on the basis of the temperature of the medium.

U.S. Pat. No. 8,320,817 B2 discloses a static elimination device that eliminates static from the front surface of a charged sheet using a contact-type static eliminator, and eliminates static from the rear surface of the charged sheet using a non-contact-type static eliminator.

Japanese Unexamined Patent Application Publication No. 2017-111329 discloses an image forming system including: a static elimination member that eliminates static from a medium; a voltage application unit that applies a static elimination voltage to the static elimination member so that a static elimination current for eliminating static from the medium flows to the medium; and a controller that, when the static elimination voltage is applied to the static elimination member, changes the transport speed of the medium, and also changes the static elimination voltage according to the change in the transport speed to thereby change the static elimination current flowing to the medium.

Japanese Patent No. 6481219 discloses a static elimination device including: multiple first discharge electrodes that oppose one surface of a sheet, are arranged on a straight line that is substantially orthogonal to the direction of movement of the sheet, and apply a direct-current voltage; and multiple second discharge electrodes that oppose the first discharge electrodes with the sheet therebetween, are arranged on a straight line that is substantially orthogonal to the direction of movement of the sheet, and apply a direct-current voltage. The first and second discharge electrodes are configured such that the polarities of adjacent discharge electrodes are reverse polarities, the polarities of opposing first and second discharge electrodes are reverse polarities, and positive ions and negative ions are present in a mixed manner between adjacent discharge electrodes.

SUMMARY

Aspects of non-limiting embodiments of the present disclosure relate to providing a static elimination device and a medium processing device using the same, with which static elimination irregularities in an intersecting direction that intersects the transport direction of a medium are suppressed compared to the case where the surfaces of static elimination members between which a medium is inserted are both made of metal.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a static elimination device including: a first static elimination member that makes contact with a medium that is transported; a second static elimination member arranged such that the medium is inserted between the first static elimination member and the second static elimination member; and a power source that applies a voltage to at least one of the first static elimination member and the second static elimination member, in which at least one of the first static elimination member and the second static elimination member has an elastic body.

BRIEF DESCRIPTION OF THE DRAWINGS

Exemplary embodiments of the present disclosure will be described in detail based on the following figures, wherein:

FIG. 28A is an explanatory diagram depicting the relationship between f/v serving as a static elimination parameter and an evaluation result therefor in a non-contact-type static eliminator in example 4, FIG. 28B is an explanatory diagram depicting an example in which the frequency is varied as a static elimination parameter, FIG. 28C is an explanatory diagram depicting an example in which f (frequency)/v (medium transport speed) is varied as a static elimination parameter, and FIG. 28D is an explanatory diagram depicting an example in which f (frequency)/v (medium transport speed)*L (housing opening width) is varied as a static elimination parameter;

DETAILED DESCRIPTION

Overview of Exemplary Embodiments

Figure 1A:
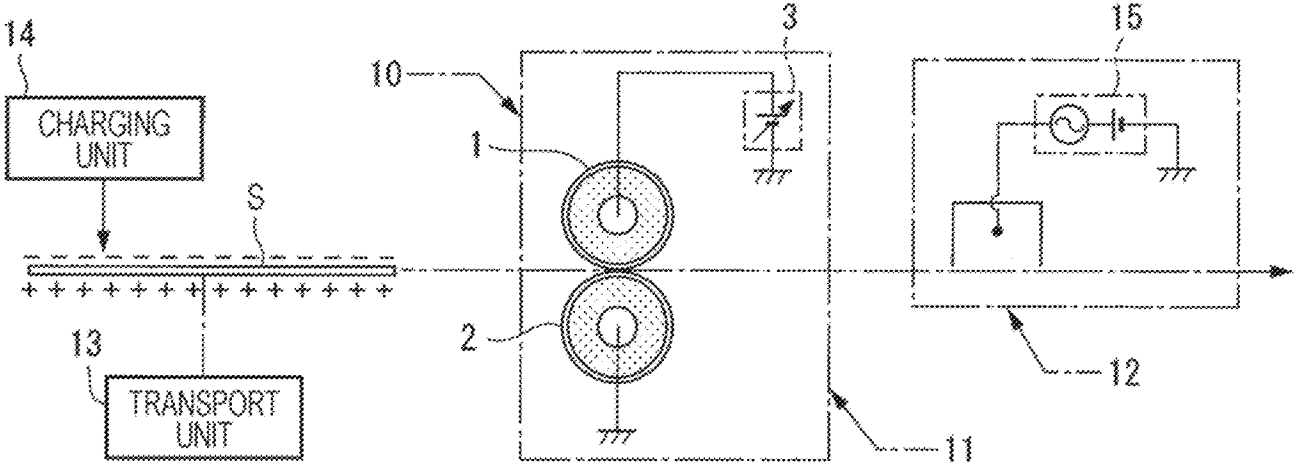
FIG. 1A is an explanatory diagram depicting an overview of an exemplary embodiment of a medium processing device using a static elimination device to which the present disclosure has been applied.

FIG. 1A depicts an overview of an exemplary embodiment of a medium processing device using a static elimination device to which the present disclosure has been applied.

In the drawing, the medium processing device includes: a transport unit 13 that transports a medium S; a charging unit 14 that is provided midway along the transport path of the medium S and charges the medium S; and a static elimination device 10 that is provided further downstream in the transport direction of the medium S than the charging unit 14 and eliminates static from the medium S that has been charged by the charging unit 14.

Here, the medium processing device is not restricted to an image forming device having an image forming unit, and also includes modes not having an image forming unit. Furthermore, included in the charging unit 14 is of course a transfer unit that applies a transfer voltage, and also a transport unit that charges by friction during transport of the medium S.

Figure 1B:
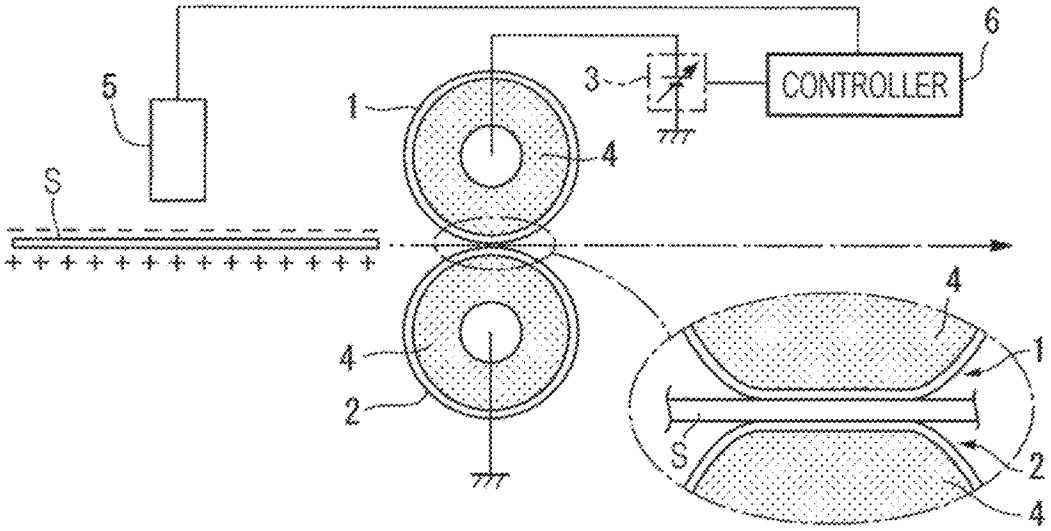
FIG. 1B is an explanatory diagram depicting a section of a contact-type static eliminator depicted in FIG. 1A.

In the present example, as depicted in FIG. 1B, the static elimination device 10 includes: a first static elimination member 1 that makes contact with the transported medium S; a second static elimination member 2 arranged such that the medium S is inserted between the first static elimination member 1 and the second static elimination member 2; and a power source 3 that applies a voltage to at least one of the first static elimination member 1 and the second static elimination member 2.

At least one of the first static elimination member 1 and the second static elimination member 2 includes: a contact-type static eliminator 11 that has an elastic body 4; and a non-contact-type static eliminator 12 that is provided further downstream in the transport direction of the medium S than the contact-type static eliminator 11, and, without making contact, eliminates residual charge of the medium S after static elimination has been carried out by the contact-type static eliminator 11.

In this kind of technical component, the first static elimination member 1 and the second static elimination member 2 are not restricted to rotating members (rollers), and, even if fixed members, broadly include members that make contact with the medium S in such a way that the medium S can be transported, with the surface that makes contact with the medium S being formed to have a curved surface section, for example.

Furthermore, the first static elimination member 1 and the second static elimination member 2 include members that do not make contact when the medium is not being passed through but make contact with the medium S when the medium S is being passed through.

In addition, with regard to applied voltage control for the power source 3, although a static elimination effect is obtained also with constant current control, constant voltage control is desirable. Furthermore, a direct-current voltage is used as the applied voltage.

Moreover, since at least one of the first static elimination member 1 and the second static elimination member 2 has the elastic body 4, when the medium S passes between the first static elimination member 1 and the second static elimination member 2, at least the first static elimination member 1 or the second static elimination member 2 having the elastic body 4 makes contact with the front surface of the medium S, and the contact state with the front surface of the medium S is maintained.

In particular, the contact state with the medium S is maintained due to elastic deformation of the elastic body 4 even in the intersecting direction of the first static elimination member 1 and the second static elimination member 2 that intersects the transport direction of the medium S, and therefore static elimination irregularities in the direction intersecting the medium S are suppressed.

Furthermore, in the present example, the contact-type static eliminator 11 carries out static elimination to a considerable extent, and the non-contact-type static eliminator 12 performs the action of uniformly leveling the static elimination amount.

Figure 2A:
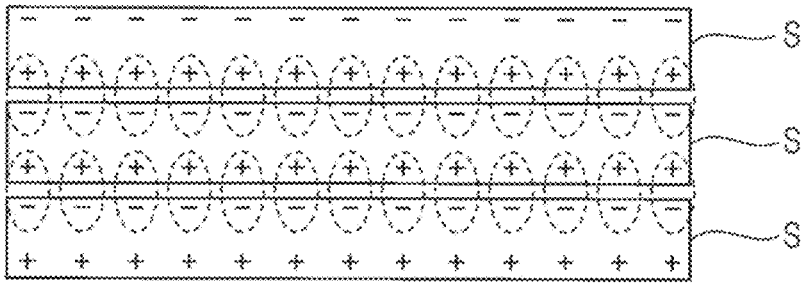
FIG. 2A is an explanatory diagram schematically depicting an example of the charging distribution of multiple mediums stacked on a medium output receiver in a mode where a static elimination device of an image forming device according to exemplary embodiment 1 is not used.

Supposing that static elimination processing carried out by the static elimination device (the contact-type static eliminator 11 and the non-contact-type static eliminator 12) of the present example is not carried out, as depicted in FIG. 2A, the front surface potential of a high-resistance medium S such as a resin film is charged to a minus potential, the rear surface potential of the medium S has an inverse positive potential due to dielectric polarization, and when such mediums S are housed in a stacked state, there is concern that the mediums S may stick to each other due to an electrostatic force.

Figure 2B:
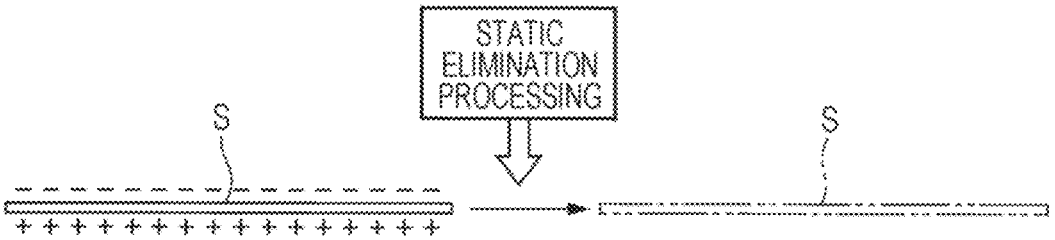
FIG. 2B is an explanatory diagram depicting the action of the static elimination device.
Figure 2C:
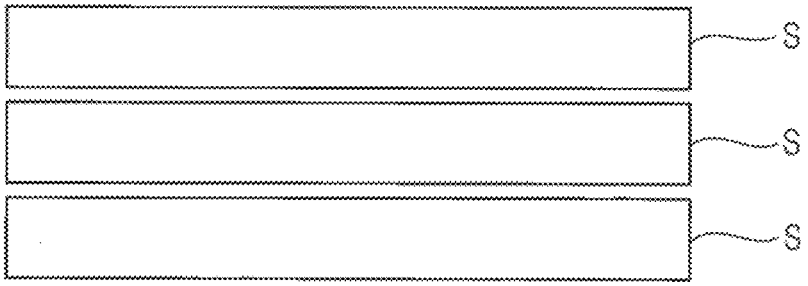
FIG. 2C is an explanatory diagram schematically depicting an example of the charging distribution of multiple mediums stacked on the medium output receiver in a mode where the static elimination device is used.

However, if static elimination processing by the static elimination device 10 (the contact-type static eliminator 11 and the non-contact-type static eliminator 12) of the present example is carried out, as depicted in FIG. 2B, even if a high-resistance medium S is used, the charging of the front surface of the medium S having passed through the contact-type static eliminator 11 and the non-contact-type static eliminator 12 is greatly eliminated, and accordingly the charging of the rear surface of the medium S is also greatly eliminated, and therefore, as depicted in FIG. 2C, when mediums S are housed in a stacked state, the concern that mediums S may stick to each other due to an electrostatic force is eliminated.

Next, a representative mode or an exemplary mode of the contact-type static eliminator 11 in particular of the static elimination device 10 according to the present exemplary embodiment will be described.

First, an exemplary mode of the first static elimination member 1 and the second static elimination member 2 is a mode in which the first static elimination member 1 and the second static elimination member 2 both have an elastic body 4. This is because it is easy to maintain a contact state with both surfaces (corresponding to both front and rear surfaces) of the medium S in the direction intersecting the medium S compared to the case where only one static elimination member has an elastic body 4.

Furthermore, a mode is desirable in which, in at least one of the first static elimination member 1 and the second static elimination member 2, the surface that makes contact with the medium S has a curved surface section. This is because there is little sliding resistance between the curved surface section of the first static elimination member 1 or the second static elimination member 2 and the medium S, and therefore there is little concern of there being reduction in the transportability of the medium S that is transported by the transport unit 13.

In particular, a mode in which at least one of the first static elimination member 1 and the second static elimination member 2 is a rotating member is desirable since transportability of the medium S would also be satisfactorily maintained.

In addition, regarding the hardness of the first static elimination member 1 or the second static elimination member 2, it is desirable that the static elimination member 1 or 2 having the elastic body 4 have an Asker C hardness that is greater than or equal to approximately 60 degrees and less than or equal to approximately 80 degrees. The present example is desirable in terms of stabilizing the state in which the medium S is held between the first static elimination member 1 and the second static elimination member 2.

Moreover, regarding the volume resistivity of the first static elimination member 1 or the second static elimination member 2, it is desirable that the first static elimination member 1 or the second static elimination member 2 having the elastic body 4 have a volume resistivity that is greater than or equal to approximately $10^6$ Ω·cm and less than or equal to approximately $10^8$ Ω·cm. This is because discharging becomes difficult when the volume resistivity is less than $10^6$ Ω·cm, and an excessive voltage necessary for discharging is required when the volume resistivity exceeds $10^8$ Ω·cm.

Furthermore, an exemplary static elimination operation performed by the contact-type static eliminator 11 is a mode in which the medium S is subjected to static elimination in such a way that the distribution between positive charge and negative charge on the front surface of the medium after static elimination becomes non-uniform compared to before static elimination. In the present example, it is sufficient that a voltage having a polarity that negates the front surface potential of the medium S be applied, but it is desirable that the potential level thereof be selected such that the front surface potential after static elimination approaches 0 or thereabouts.

More desirable is a mode in which the medium S be subjected to static elimination in such a way that in the distribution of front surface charge after static elimination there is an increase in the proportion of the charge that was dominant before static elimination. This is because, if static were eliminated such that there was a decrease in the proportion of charge that was dominant before static elimination, there would be a greater distribution of charge having different polarities, and there would more likely be variation in the distribution of the front surface charge of the medium after static elimination.

Furthermore, although the applied voltage of the power source 3 may be used in a uniform manner, from the viewpoint of applying an optimum voltage for static elimination, a mode may be implemented in which there is provided a controller 6 that controls the applied voltage of the power source 3 in accordance with at least one front surface potential from before and after static is eliminated from the medium S. In the present example, it is sufficient for a surface potential meter 5 to be installed in a location that is at least one of before and after the static elimination performed by the contact-type static eliminator 11, and for the front surface potential of the medium S to be measured by the surface potential meter 5.

At such time, the controller 6 may control the applied voltage of the power source 3 in accordance with the at least one front surface potential from before static is eliminated from the medium S, or may control the applied voltage of the power source 3 in accordance with the at least one front surface potential from after static is eliminated from the medium S. In the former mode it is possible for feedback control to be performed on the applied voltage of the power source 3 from the first sheet of the medium S, and in the latter mode it is possible for feedback control to be performed on the applied voltage of the power source 3 from the second sheet of the medium S, and, since the front surface potential of the medium S after static elimination is measured, for the surface potential meter 5 there is no need to give consideration to a high potential being measured.

Furthermore, although it is acceptable for the controller 6 to control the applied voltage of a power source 15 of the non-contact-type static eliminator 12, in the present example the static elimination operation performed by the non-contact-type static eliminator 12 targets the front surface charge of the medium S that remains after the static elimination performed by the contact-type static eliminator 11; therefore, to begin with there is little front surface potential of the medium S to be subjected to static elimination, and there is little need for the applied voltage of the power source 15 to be controlled by the controller 6. Therefore, a mode is adopted in which the applied voltage is not controlled for the power source 15 from the viewpoint of further simplifying the control system.

Furthermore, in a mode in which the charging unit 14 is a transfer unit that transfers an image with the medium S being inserted between transfer members having a paired structure for example, regarding the contact-type static eliminator 11, it is acceptable for the medium contact pressure (nip pressure) between the first static elimination member 1 and the second static elimination member 2 to be set to be lower than the medium contact pressure between the transfer members having a paired structure. Regarding this, image transferability is necessary when considering the medium contact pressure between the transfer members having a paired structure, and accordingly it is necessary to set the medium contact pressure to be high to a certain extent. However, regarding the medium contact pressure between the first static elimination member 1 and the second static elimination member 2, there is no such requirement as in the case of the transfer unit, and the static elimination operation is possible as long as the contact state with the medium S is maintained, and therefore it is acceptable for a low medium contact pressure to be selected. Furthermore, by suppressing the nip pressure between the first static elimination member 1 and the second static elimination member 2 to be lower than the medium contact pressure between the transfer members, it is possible to suppress an excessive load on the first static elimination member 1 and the second static elimination member 2 and to suppress abrasion and deformation.

In addition, in a mode in which a medium inverting unit (not depicted in FIG. 1) is provided further upstream in the transport direction of the medium S than the static elimination device 10, it is desirable to have a switching unit (not depicted in FIG. 1) that switches the polarity of the applied voltage of the power source 3 in accordance with whether or not the medium is inverted by the medium inverting unit.

Hereinafter, the present disclosure will be described in detail on the basis of exemplary embodiments depicted in the appended drawings.

Exemplary Embodiment 1

Figure 3:
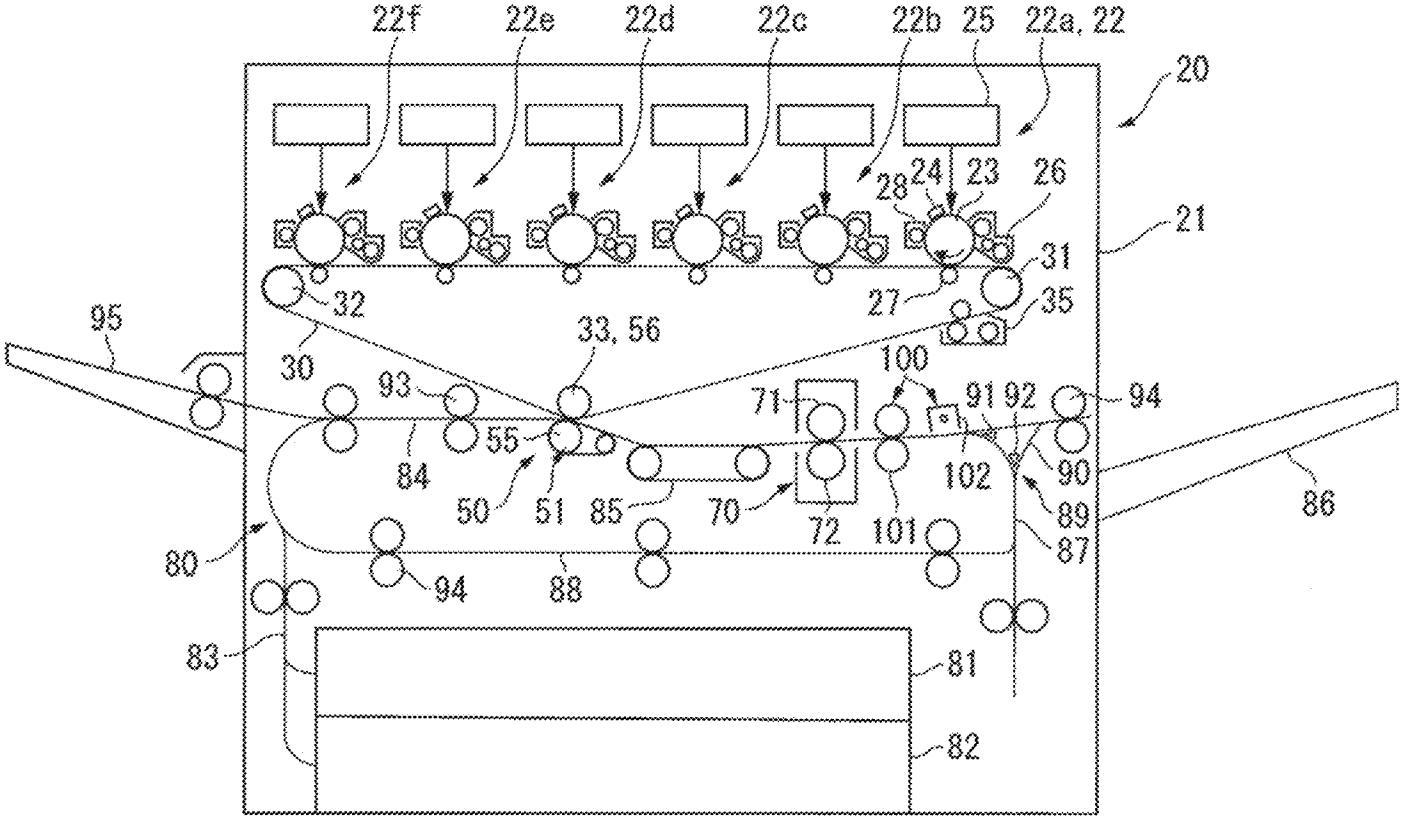
FIG. 3 is an explanatory diagram depicting the overall configuration of the image forming device according to exemplary embodiment 1.

FIG. 3 depicts the overall configuration of an image forming device according to exemplary embodiment 1.

—Overall Configuration of Image Forming Device—

In the drawing, an image forming device 20 includes, within an image forming device housing 21: image forming units 22 (specifically 22*a* to 22*f*) that form images of multiple color components (in the present exemplary embodiment, white #1, yellow, magenta, cyan, black, and white #2); a belt-like intermediate transfer body 30 that sequentially transfers (first transfer) and retains the color component images formed by the image forming units 22; a second transfer device 50 that performs a second transfer in which the color component images transferred onto the intermediate transfer body 30 are transferred to the medium S; a fixing device 70 that causes the images subjected to the second transfer to be fixed to the medium S; and a medium transport system 80 that transports the medium S to a second transfer area. In the present example, white materials having the exact same color are used for white #1 and white #2; however, it should be noted that different white materials may be used depending on whether located at a lower layer or a higher layer than the other color component images on the medium S, and it goes without saying that a material having a transparent color may be used instead of white #1 and white #2 or a material having another special color may be used, for example.

—Image Forming Units—

In the present exemplary embodiment, the image forming units 22 (22*a* to 22*f*) each have a drum-like photoconductor 23, and around each photoconductor 23 there is arranged: a charging device 24 such as a corotron or a transfer roller with which the photoconductor 23 is charged; an exposure device 25 such as a laser scanning device with which an electrostatic latent image is written onto the charged photoconductor 23; a developing device 26 with which the electrostatic latent image written onto the photoconductor 23 is developed using color component toners; a first transfer device 27 such as a transfer roller with which the toner images on the photoconductor 23 are transferred to the intermediate transfer body 30; and a photoconductor cleaning device 28 with which residual toner on the photoconductor 23 is removed.

Furthermore, the intermediate transfer body 30 extends across multiple stretching rollers 31 to 33 with the stretching roller 31 for example being used as a driving roller which is driven by a driving motor that is not depicted, and the intermediate transfer body 30 moves in a circulating manner due to the driving roller. In addition, an intermediate transfer body cleaning device 35 for removing residual toner on the intermediate transfer body 30 after the second transfer is provided between the stretching rollers 31 and 33.

—Second Transfer Device—

Figure 4:
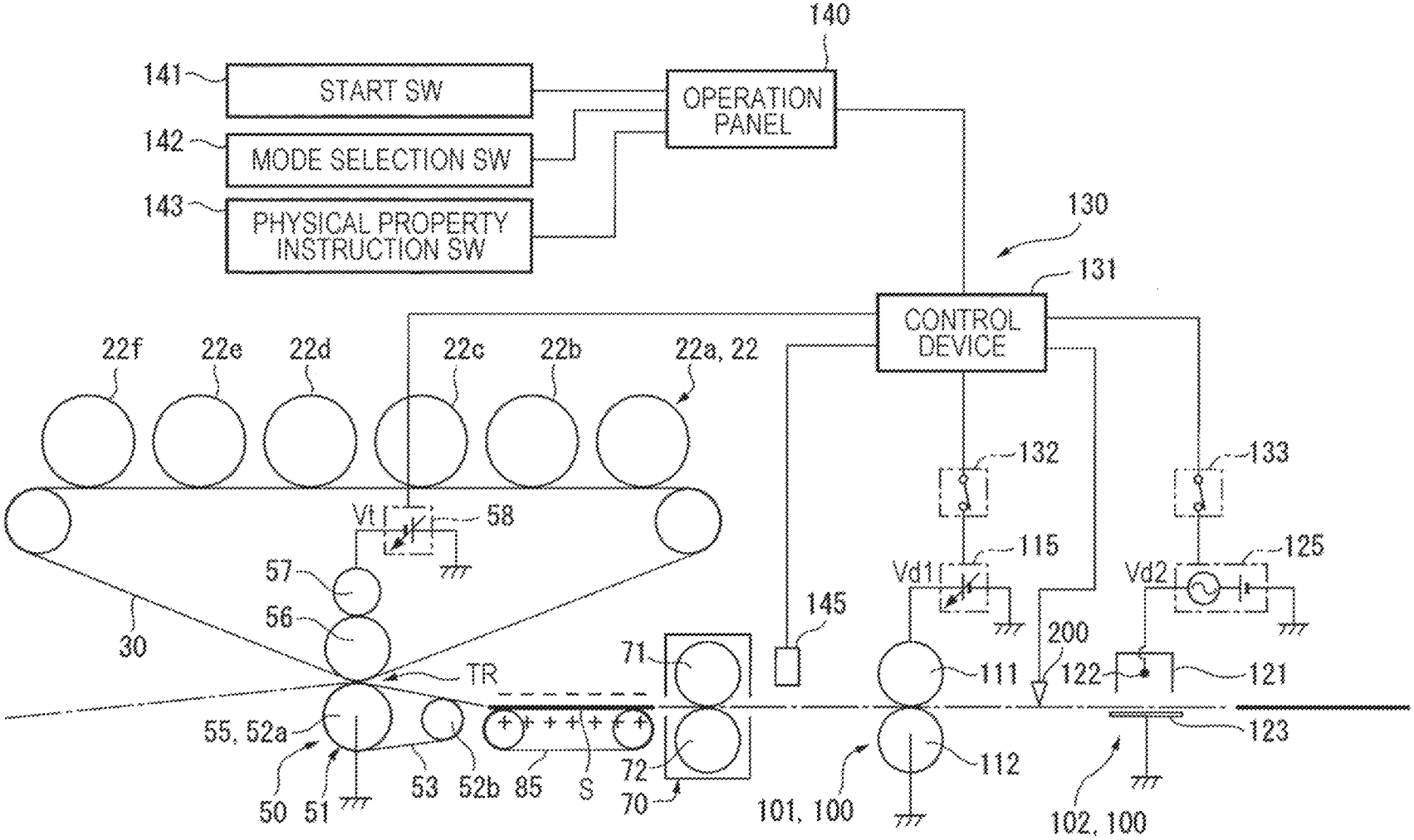
FIG. 4 is an explanatory diagram depicting an example configuration in the vicinity of a second transfer unit and in the vicinity of a static elimination unit of the image forming device according to exemplary embodiment 1.

In addition, in the second transfer device 50, a belt transfer module 51 in which a transfer transport belt 53 is stretched across multiple stretching rollers 52 (specifically 52*a* and 52*b*) is arranged so as to make contact with the surface of the intermediate transfer body 30, as depicted in FIGS. 3 and 4.

Here, the transfer transport belt 53 is a semiconductive belt having a volume resistivity of approximately $10^6$ to $10^{12}$ Ω·cm for which a material such as chloroprene is used, one stretching roller 52*a* is configured as an elastic transfer roller 55, this elastic transfer roller 55 is arranged pressed against the intermediate transfer body 30 due to the second transfer area TR with the transfer transport belt 53 interposed, a stretching roller 33 of the intermediate transfer body 30 is arranged opposing the elastic transfer roller 55 as an opposing roller 56 constituting an opposing electrode, and a transport path for the medium S is formed from the location of the one stretching roller 52*a* to the other stretching roller 52*b*.

Also, in the present example, the elastic transfer roller 55 has a configuration in which an elastic layer obtained by mixing carbon black or the like with urethane foam rubber or EPDM covers the periphery of a metal shaft.

In addition, a transfer bias Vt from a transfer power source 58 is applied via a conductive power supply roller 57 to the opposing roller 56 (also used as the stretching roller 33 in the present example), and meanwhile the elastic transfer roller 55 (the one stretching roller 52*a*) is grounded via a metal shaft which is not depicted, and a predetermined transfer electric field is formed between the elastic transfer roller 55 and the opposing roller 56. It should be noted that the other stretching roller 52*b* is also grounded, and the transfer transport belt 53 is prevented from being charged. Furthermore, when consideration is given to the detachability of the medium S at the downstream end of the transfer transport belt 53, it is effective for the stretching roller 52*b* at the downstream side to have a smaller diameter than the stretching roller 52*a* at the upstream side.

—Fixing Device—

The fixing device 70 has a heat fixing roller 71 that can be rotationally driven arranged in contact with the image holding surface side of the medium S, and a pressure fixing roller 72 that is arranged pressed against and opposing the heat fixing roller 71 and rotates following the heat fixing roller 71. An image held on the medium S is passed through a pressure contact region between both fixing rollers 71 and 72, and the image is fixed by using heat and pressure. It should be noted that the fixing scheme of the fixing device 70 is not restricted to the mode given in the exemplary embodiment, and it is acceptable for a non-contact fixing scheme using laser light or the like to be selected as appropriate.

—Medium Transport System—

In addition, the medium transport system 80 has medium supply containers 81 and 82 at multiple levels (two levels in the present example), the medium S supplied from either of the medium supply containers 81 and 82 arrives at the second transfer area TR via a horizontal transport path 84 that extends in a substantially horizontal direction from a vertical transport path 83 that extends in a substantially vertical direction, and thereafter the medium S on which a transferred image is held arrives at the fixing site according to the fixing device 70 via a transport belt 85, and is output to a medium output receiver 86 provided at a side of the image forming device housing 21.

Also, additionally, the medium transport system 80 has a branch transport path 87 capable of inverting that branches downward from a portion located downstream in the medium transport direction from the fixing device 70 of the horizontal transport path 84. The medium S is inverted due to the branch transport path 87 and via a transport path 88 once again returns to the horizontal transport path 84 from the vertical transport path 83. An image is transferred onto the rear surface of the medium S due to the second transfer area TR, and the medium S is output to the medium output receiver 86 through the fixing device 70. Furthermore, midway along the branch transport path 87, there is provided a medium inverting mechanism 89 by which the medium S having passed along the horizontal transport path 84 is inverted and output to the medium output receiver 86. The medium inverting mechanism 89 has a branch return transport path 90 that branches from midway along the branch transport path 87 and transports the inverted medium S toward the medium output receiver 86, switching gates 91 and 92 are respectively installed at a boundary section between the horizontal transport path 84 and the branch transport path 87 and a boundary section between the branch transport path 87 and the branch return transport path 90, and the medium S having passed along the horizontal transport path 84 is inverted and output to the medium output receiver 86.

Furthermore, alignment rollers 93 that align the medium S and supply the medium S to the second transfer area TR are provided in the medium transport system 80, and in addition an appropriate number of transport rollers 94 are provided on the transport paths 83, 84, 87, and 88. Moreover, at the opposite side of the image forming device housing 21 to the medium output receiver 86, there is provided a manual medium supplier 95 with which the medium can be manually supplied to the horizontal transport path 84.

—Basic Configuration of Static Elimination Device—

In the present exemplary embodiment, on the horizontal transport path 84 that leads from the fixing device 70 to the medium output receiver 86, a static elimination device 100 is provided further upstream in the transport direction of the medium S than the branch transport path 87 that leads to the medium inverting mechanism 89.

In the present example, the static elimination device 100 includes: a contact-type static eliminator 101 that comes into contact with the medium S and eliminates the majority of the charge that has been charged to the medium S; and a non-contact-type static eliminator 102 that is provided further downstream in the transport direction of the medium S than the contact-type static eliminator 101, and, without making contact, eliminates residual charge of the medium S that remains after static elimination has been carried out by the contact-type static eliminator 101.

Hereinafter, the contact-type static eliminator 101 and the non-contact-type static eliminator 102 will be described.

<Contact-Type Static Eliminator>

Figure 5A:
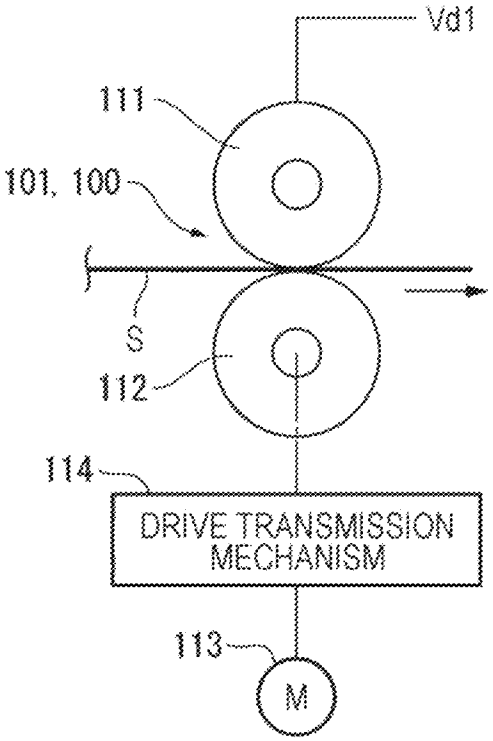
FIG. 5A is an explanatory diagram depicting an example configuration of a contact-type static eliminator used in exemplary embodiment 1.

As depicted in FIGS. 3, 4, and 5A, in the contact-type static eliminator 101, static elimination rollers 111 and 112 having a paired structure are arranged in contact, a driving force from a driving motor 113 is transmitted via a drive transmission mechanism 114 such as a gear to either one of the static elimination rollers, the static elimination roller 111 is made to come into contact with and thereby follow the static elimination roller 112, and the medium S is held between the static elimination rollers 111 and 112 and is transported.

In addition, in the present example, a static elimination power source 115 is connected to one static elimination roller 111, a static elimination bias Vd1 (a positive direct-current voltage is used in the present example) is applied from the static elimination power source 115, and the other static elimination roller 112 is grounded.

It should be noted that it is acceptable for the static elimination power source 115 to be installed at either the front-surface side or the rear-surface side of the medium S, and in a mode where installed at the rear-surface side of the medium S, it is sufficient to use the opposite polarity to the static elimination bias or the static elimination current used in a mode where installed at the front-surface side of the medium S.

Figure 5B:
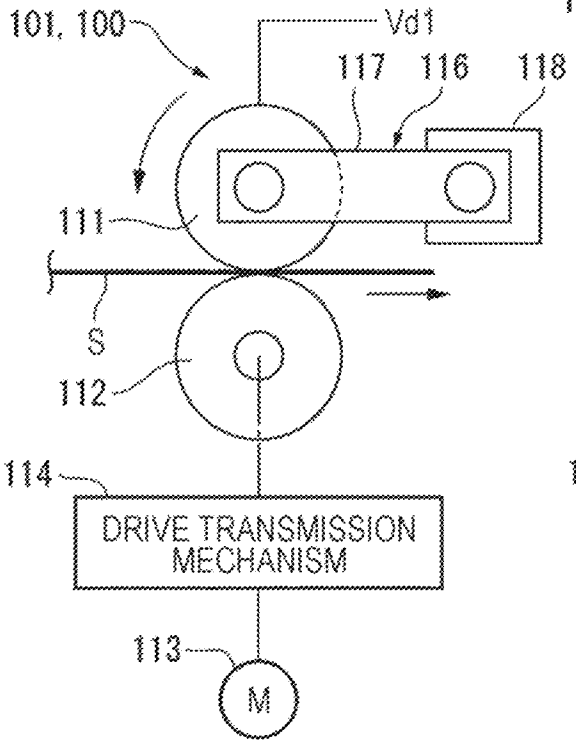
FIG. 5B is an explanatory diagram depicting another example configuration of a contact-type static eliminator used in exemplary embodiment 1.
Figure 5C:
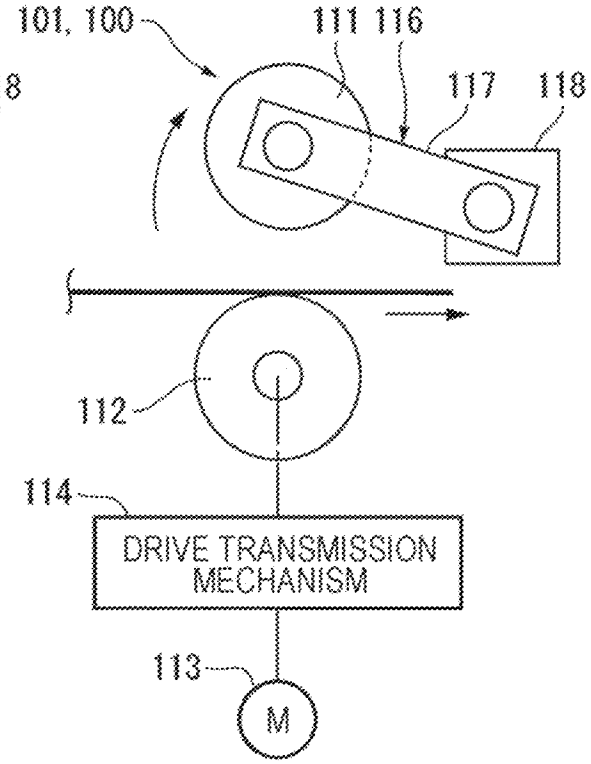
FIG. 5C is an explanatory diagram depicting a state when a static elimination operation is not carried out by the contact-type static eliminator depicted in FIG. 5B.

In particular, as a mode that is different from the present example, the contact-type static eliminator 101 may be provided with a contact/separation mechanism 116 that causes one static elimination roller 111 to come into contact with or to separate from the other static elimination roller 112, as depicted in FIGS. 5B and 5C. The contact/separation mechanism 116 used in the present example has an oscillating arm 117 that oscillates about an oscillation support point for example, the static elimination roller 111 is rotatably supported at the tip-end side away from the oscillation support point of the oscillating arm 117, the oscillating arm 117 is made to oscillate in the clockwise direction or the counterclockwise direction by a drive source 118 such as a driving motor, and the static elimination roller 111 is arranged in a non-contact retracted position or a contact position with respect to the static elimination roller 112.

<Non-Contact-Type Static Eliminator>

In the present example, as depicted in FIG. 4, for example, the non-contact-type static eliminator 102 has a static elimination housing 121 having channel cross-sectional shape that opens towards the front-surface side of the medium S transported along the horizontal transport path 84, a discharge wire 122 extends in the longitudinal direction within the static elimination housing 121, a static elimination power source 125 is connected to the discharge wire 122, a static elimination bias Vd2 (an alternating-current power source 126 that outputs an alternating-current voltage component and a direct-current power source 127 that outputs a direct-current voltage component are used in the present example (see FIG. 6)) is applied from the static elimination power source 125, and meanwhile an earth electrode 123 configured from a grounded metal plate is arranged at the rear-surface side of the medium S.

A mode in which only one discharge wire 122 is used is adopted in the present example, but it should be noted that the present disclosure is not restricted thereto, and multiple discharge wires 122 may be used. Furthermore, a so-called corotron scheme is adopted in the present example, but the present disclosure is not restricted thereto, and it goes without saying that a mode may be adopted in which a grid plate serving as a control electrode is added at a location facing the opening in the static elimination housing 121 (a so-called scorotron scheme). Alternatively, a mode may be adopted in which a needle-like electrode described later is provided instead of the discharge wire 122. Furthermore, it is acceptable for the static elimination power source 125 to be installed at either the front-surface side or the rear-surface side of the medium S, and the static elimination power source 125 may be installed at both sides.

<Static Elimination Characteristics of the Static Eliminators>

Here, the static elimination characteristics of the static eliminators 101 and 102 will be briefly described.

Figure 6A:
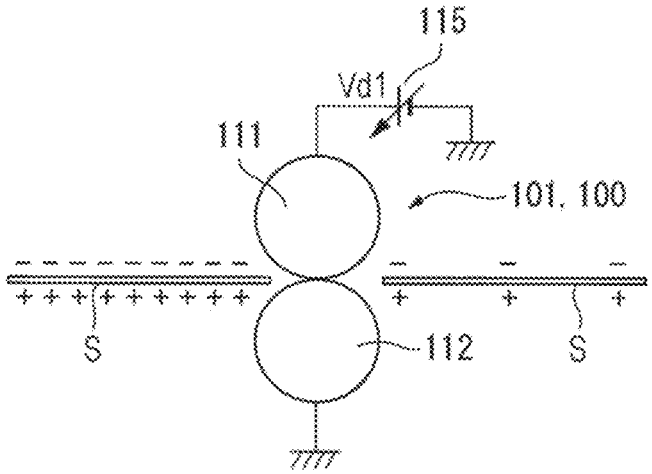
FIG. 6A is an explanatory diagram schematically depicting the static elimination operation carried out by the contact-type static eliminator.
Figure 6B:
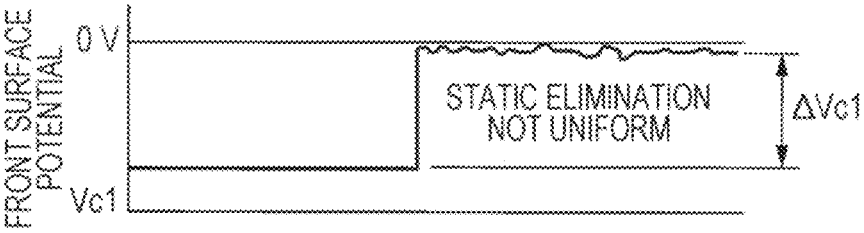
FIG. 6B is an explanatory diagram depicting a change trend in the charged state of a medium that accompanies the static elimination operation carried out by the contact-type static eliminator.
Figure 7A:
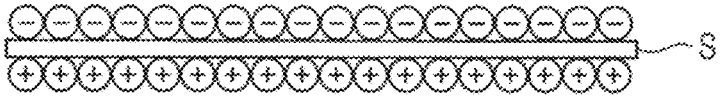
FIG. 7A is an explanatory diagram depicting an example of the charged state of a medium.

Here, it is assumed that the medium S has a high resistance (dielectric) similar to a resin film, and, for example, a medium S passing through the second transfer device 50 receives a transfer electric field and is charged. At such time, as depicted in FIGS. 6A and 6B and FIG. 7A, assuming that the front surface potential of the medium S is Vc1 (−) having a negative polarity, a charge e+ having a positive polarity is inductively polarized at the rear surface of the medium S.

Figure 7B:
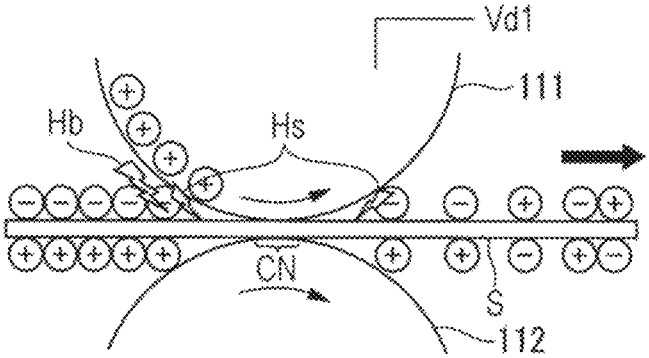
FIG. 7B is an explanatory diagram depicting the principle of the static elimination operation carried out by the contact-type static eliminator.

In this state, in the contact-type static eliminator 101, the static elimination bias Vd1 is applied to one static elimination roller 111, and thus a corona discharge occurs before and after a contact region (nip region) CN between the one static elimination roller 111 and the other static elimination roller 112, as depicted in FIG. 7B. In particular, in the present example, the medium S having a high front surface potential before static elimination enters a space at the entrance side of the contact region CN between the static elimination rollers 111 and 112 (corresponding to the upstream side in the transport direction of the medium S), and consequently a large current discharge Hb occurs in a region away from the contact region CN and also a weak current discharge Hs occurs in a region close to the contact region CN. The medium S having a low front surface potential after static elimination passes through a space at the exit side of the contact region CN between the static elimination rollers 111 and 112 (corresponding to the downstream side in the transport direction of the medium S), and consequently a weak current discharge Hs occurs in a region close to the contact region CN. As a result, a positive charge is applied at a predetermined amount to the front surface of the charged medium S, and the negative charge e− on the front surface of the medium S is eliminated by an amount commensurate with the applied charge amount. In this state, the front surface charge of the medium S decreases, and accordingly the dielectrically polarized positive charge e+ also decreases at the rear surface of the medium S. Therefore, as depicted in FIG. 6B, the front surface potential of the medium S decreases from Vc1 (−) by ΔVc1 in terms of absolute value; however, in the contact-type static eliminator 101, it is possible to ensure that the absolute value of ΔVc1 as a static elimination amount is large to a certain extent, and therefore there is a tendency for there to be a large amount of variation in the front surface potential of the medium S after static elimination and the static elimination is likely to not be uniform.

Figure 6C:
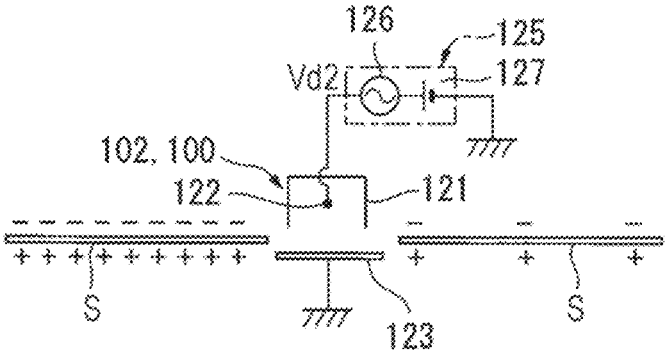
FIG. 6C is an explanatory diagram schematically depicting a static elimination operation carried out by a non-contact-type static eliminator.
Figure 6D:
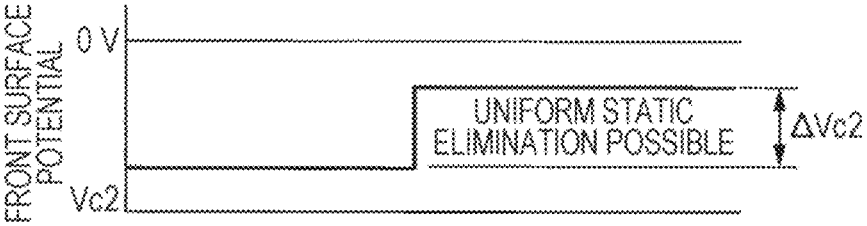
FIG. 6D is an explanatory diagram depicting a change trend in the charged state of a medium that accompanies the static elimination operation carried out by the non-contact-type static eliminator.
Figure 7C:
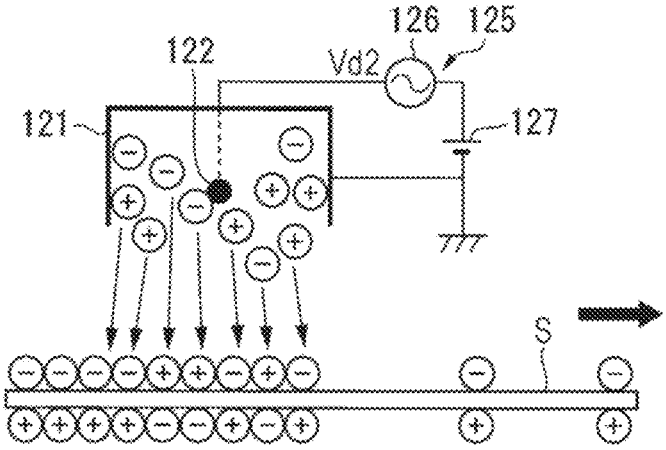
FIG. 7C is an explanatory diagram depicting the principle of the static elimination operation carried out by the non-contact-type static eliminator.

Meanwhile, regarding the static elimination characteristics of the non-contact-type static eliminator 102, as depicted in FIGS. 6C and 6D, assuming that the front surface potential of the medium S is Vc2 (−) having a negative polarity, the non-contact-type static eliminator 102 applies the static elimination bias Vd2 (an alternating-current voltage component superposed by a direct-current voltage component) to the discharge wire 122, and thus, as depicted in FIG. 7C, an AC corona discharge occurs between the discharge wire 122 and the static elimination housing 121, and positive ions (+) and negative ions (−) are generated at the periphery of the discharge wire 122. As a result, the positive ions (+) and negative ions (−) generated by the corona discharge are drawn by an electric field that occurs with the medium S and are supplied to the front surface of the charged medium S, the negative charge e− on the front surface of the medium S is eliminated by an amount commensurate with the amount of positive ions (+) supplied, and the positive charge e+ on the front surface of the medium S is eliminated by an amount commensurate with the amount of negative ions (−) supplied. Furthermore, the rear surface of the medium S has a zero potential by way of the earth electrode 123, and therefore the charge e+ on the rear surface of the dielectrically polarized medium S easily escapes to the earth electrode 123. Therefore, as depicted in FIG. 6D, the front surface potential of the medium S decreases from Vc2 (−) by ΔVc2 in terms of absolute value; however, in the non-contact-type static eliminator 102, although it is not possible to ensure that the absolute value of ΔVc2 is so large as a static elimination amount, the amount of variation in the front surface potential of the medium S after static elimination is small, and it is possible for static to be eliminated in a uniform manner.

—Static Elimination Control System—

In the present exemplary embodiment, as depicted in FIG. 4, the static elimination device 100 (the contact-type static eliminator 101 and the non-contact-type static eliminator 102) determines whether or not static elimination is necessary by way of a static elimination control system 130, and, in a case where static elimination is necessary, decides a static elimination scheme and static elimination conditions, and carries out a static elimination operation.

In the present example, as depicted in FIG. 4, the static elimination control system 130 has a control device 131 constituted by a microcomputer for example, and the control device 131 has connected thereto an operation panel 140 of the image forming device 20 and an environment sensor 145 that detects environmental conditions (temperature and humidity for example). Furthermore, the control device 131 and the static elimination power sources 115 and 125 of the static eliminators 101 and 102 are selectively connected via selection switches 132 and 133.

Here, the operation panel 140 is provided with: a start switch 141 ("switch" is written as "SW" in FIG. 4, and likewise hereinafter) for starting image forming processing performed by the image forming device 20; a mode selection switch 142 that selects various types of operation modes (singled-sided/double-sided printing modes, standard/high image quality printing modes, and so forth); and a physical property instruction switch 143 that instructs the physical properties of the medium S (resistance, thickness, basis weight, size, and so forth). It should be noted that regarding the physical properties of the medium S, a detector that detects the physical properties of the medium S (resistance, thickness, size, and so forth) is installed in the medium supply containers 81 and 82 or on a transport path, for example, and it goes without saying that physical property information of the medium S may be acquired by the detector.

—Image Forming Processing of the Image Forming Device—

Next, the image forming processing of the image forming device according to the present exemplary embodiment will be described in accordance with the flowchart depicted in FIG. 8.

First, as depicted in FIGS. 3 and 4, when the start switch 141 is turned on, the image forming device 20 starts a print job. In this state, the medium S is supplied from the medium supply container 81 or 82 or the manual medium supplier 95, image forming processing in which an image is transferred to the medium S is carried out in the image forming units 22, and the created image is moved to the second transfer area TR via the intermediate transfer body 30.

Thereafter, the medium S is transported along the horizontal transport path 84 to the second transfer area TR, and a transfer operation performed by the second transfer device 50 is carried out. Thereafter, the medium S onto which the image has been transferred passes through the fixing device 70 and the image is fixed to the medium S, and the medium S to which the image has been fixed moves toward the static elimination device 100.

In this state, the control device 131 reads physical property information of the medium S (medium type, for example) on the basis of instruction information from the physical property instruction switch 143 of the operation panel 140, for example, and determines whether or not static elimination by the static elimination device 100 is necessary. As a method for this determination, for example, it is sufficient to confirm whether or not the front surface resistance of the medium S is greater than or equal to a level requiring static elimination (1011Ω/□, for example) from the physical property information of the medium S (medium type, for example), and to determine that static elimination is required in the case of a medium S having a level that is greater than or equal to that requiring static elimination. However, it is not absolutely necessary for the front surface resistance of the medium S to be determined as internal processing, and it may be determined that static elimination is necessary from only information on the medium type.

In the present example, in the aforementioned processing to determine whether or not static elimination is required, if it is determined that static elimination is required, the medium S is transported via the static elimination processing performed by the static elimination device 100, and if it is determined that static elimination is not required, the static elimination processing performed by the static elimination device 100 is not carried out and the medium S is transported toward the medium output receiver 86.

Here, in the present exemplary embodiment, when the contact-type static eliminator 101 is in the mode depicted in FIG. 5A, the static elimination rollers 111 and 112 maintain a contact state regardless of whether or not static elimination is required. Although, in the present example, the static elimination bias Vd1 is applied in the case where static elimination is required, and the static elimination bias Vd1 is not applied in the case where static elimination is not required.

On the other hand, when the contact-type static eliminator 101 is in the mode depicted in FIGS. 5B and 5C, the static elimination rollers 111 and 112 having a paired structure are maintained in a contact state in the case where static elimination is required, and the static elimination rollers 111 and 112 having a paired structure are maintained in a non-contact state by the contact/separation mechanism 116 in the case where static elimination is not required.

Next, processing in the case where static elimination is required will be described.

In the present example, the control device 131, upon determining that static elimination is required, decides a static elimination scheme and decides static elimination conditions.

<Deciding the Static Elimination Scheme>

Figures 9A, 9B:
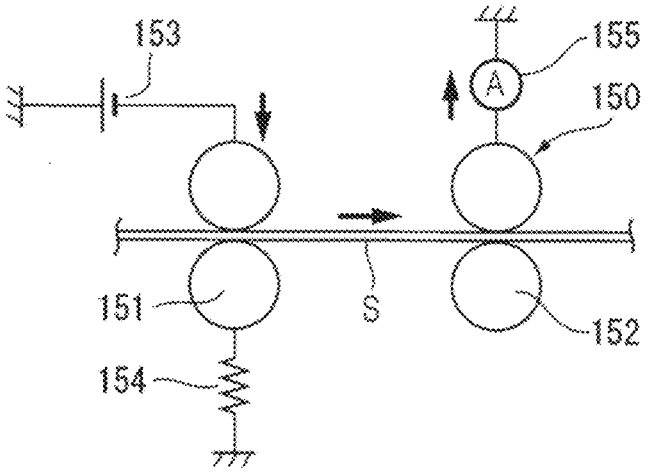
FIG. 9A is an explanatory diagram depicting an example of a "method for deciding a static elimination scheme" depicted in FIG. 8.
FIG. 9B is an explanatory diagram depicting an example where the front surface resistance a medium is measured.

In the present example, the control device 131 recognizes physical property information of the medium S (medium type, for example) on the basis of instruction information from the physical property instruction switch 143, for example, and determines whether the front surface resistance (Ω/□) of the medium S is a low resistance, an intermediate resistance, or a high resistance, as depicted in FIG. 9A, for example. Here, a low resistance is greater than or equal to 1011 and less than 1013, an intermediate resistance is greater than or equal to 1013 and less than 1015, and a high resistance is greater than or equal to 1015 and less than 1018.

Then, in the present example, from the viewpoint of suppressing power consumption to the minimum required, when the front surface resistance of the medium S is a low resistance, the selection switches 132 and 133 are both turned off so that neither of the contact-type static eliminator 101 and the non-contact-type static eliminator 102 is selected, and when the front surface resistance of the medium S is an intermediate resistance, the selection switch 132 is turned off and the selection switch 133 is turned on so that only the non-contact-type static eliminator 102 is selected, and furthermore when the medium S has a high resistance, both the selection switches 132 and 133 are turned on so that both the contact-type static eliminator 101 and the non-contact-type static eliminator 102 are selected.

However, from the viewpoint of increasing the accuracy of the static elimination performed by the static elimination device 100, it goes without saying that both the contact-type static eliminator 101 and the non-contact-type static eliminator 102 may be used regardless of whether the medium S has a low resistance, an intermediate resistance, or a high resistance. Furthermore, in the present example, a scheme in which only the contact-type static eliminator 101 is selected is not provided, but a scheme in which only the contact-type static eliminator 101 is selected may be provided in the case of an intermediate resistance, for example.

Furthermore, in the present example, a scheme is adopted in which the front surface resistance of the medium S is determined based on instruction information from the physical property instruction switch 143; however, the present disclosure is not restricted thereto, and the front surface resistance of the medium S may be measured and determined using a resistance measurement circuit 150 depicted in FIG. 9B, for example. In the resistance measurement circuit 150 depicted in FIG. 9B, measurement rollers 151 and 152 having paired structures are installed side-by-side in the transport direction of the medium S, a measurement power source 153 is connected to one of the measurement rollers 151 having a paired structure located upstream in the transport direction of the medium S and the other is grounded by way of a resistance 154, and an ammeter 155 is provided between ground and one of the measurement rollers 152 having a paired structure located downstream in the transport direction of the medium S. It should be noted that transport members for the medium S (the alignment rollers 93 or the transport rollers 94) may also be used as the measurement rollers 151 and 152, or the measurement rollers 151 and 152 may be provided separately from the transport members.

In the present example, assuming that a medium having either a low resistance, an intermediate resistance, or a high resistance is used as the medium S for example, in the case where the medium S has a high resistance, even if the medium S is arranged extending between the measurement rollers 151 and 152 having paired structures, a measurement current from the measurement power source 153 flows across the measurement rollers 151 having a paired structure, and hardly none propagates through the medium S and reaches the ammeter 155 near the measurement rollers 152.

In contrast, in a case where the medium S has an intermediate resistance or a low resistance, these front surface resistances of the medium S are small compared to a medium S having a high resistance, and therefore, when the medium S is arranged extending between the measurement rollers 151 and 152 having paired structures, a portion of the measurement current from the measurement power source 153 flows across the measurement rollers 151 having a paired structure, the remaining measurement current propagates through the medium S and reaches the ammeter 155 near the measurement rollers 152, and the front surface resistance of the medium S is calculated according to the measurement current measured by the ammeter 155 and the applied voltage of the measurement power source 153.

It should be noted that, regarding this type of resistance measurement circuit 150, it goes without saying a configuration may be adopted in which, for example, an ammeter is interposed between ground and the elastic transfer roller 55 of the second transfer device 50, a transfer current is measured by this ammeter, a system resistance of the second transfer area TR is calculated from a transfer bias and the transfer current, and the front surface resistance of the medium S is computed.

<Deciding the Static Elimination Conditions>

Next, a method for deciding static elimination conditions in the present example will be described.

In the present example, as depicted in FIGS. 4 and 9, the control device 131 computes the front surface resistance of the medium S on the basis of a transfer condition according to the second transfer device 50 (the transfer bias Vt of the constant voltage control scheme being corrected based on environment information from the environment sensor 145, for example) and also instruction information (medium type, for example) from the physical property instruction switch 143, and predicts the charging potential of the medium S having passed through the second transfer device 50. Moreover, it goes without saying that the front surface potential of the medium S charged by the second transfer device 50 may be measured using a potential probe (not depicted).

Also, as a static elimination condition of the contact-type static eliminator 101, it is sufficient for the static elimination bias Vd1 to be decided such that a front surface potential Vc of the medium S that has been predicted or measured is reduced by the majority thereof in terms of absolute value (in the present example, the target front surface potential is Vc1). In addition, as a static elimination condition of the non-contact-type static eliminator 102, it is sufficient for the static elimination bias Vd2 to be decided depending on the static elimination condition of the contact-type static eliminator 101 (the target front surface potential Vc1 of the medium S), and for the front surface potential of the medium S to become Vc2 (substantially 0 in the present example).

It should be noted that, in the present example, a scheme is adopted in which the static elimination condition of the non-contact-type static eliminator 102 is dependent on the static elimination condition of the contact-type static eliminator 101; however, the present disclosure is not restricted thereto, and it goes without saying that a scheme may be adopted in which, for example, the static elimination condition of the non-contact-type static eliminator 102 is decided in advance, and the static elimination condition of the contact-type static eliminator 101 is made to be dependent on the static elimination condition of the non-contact-type static eliminator 102.

In this way, once the static elimination scheme and the static elimination conditions have been decided, appropriate static elimination processing is carried out according to the front surface resistance of the medium S.

Figure 8:
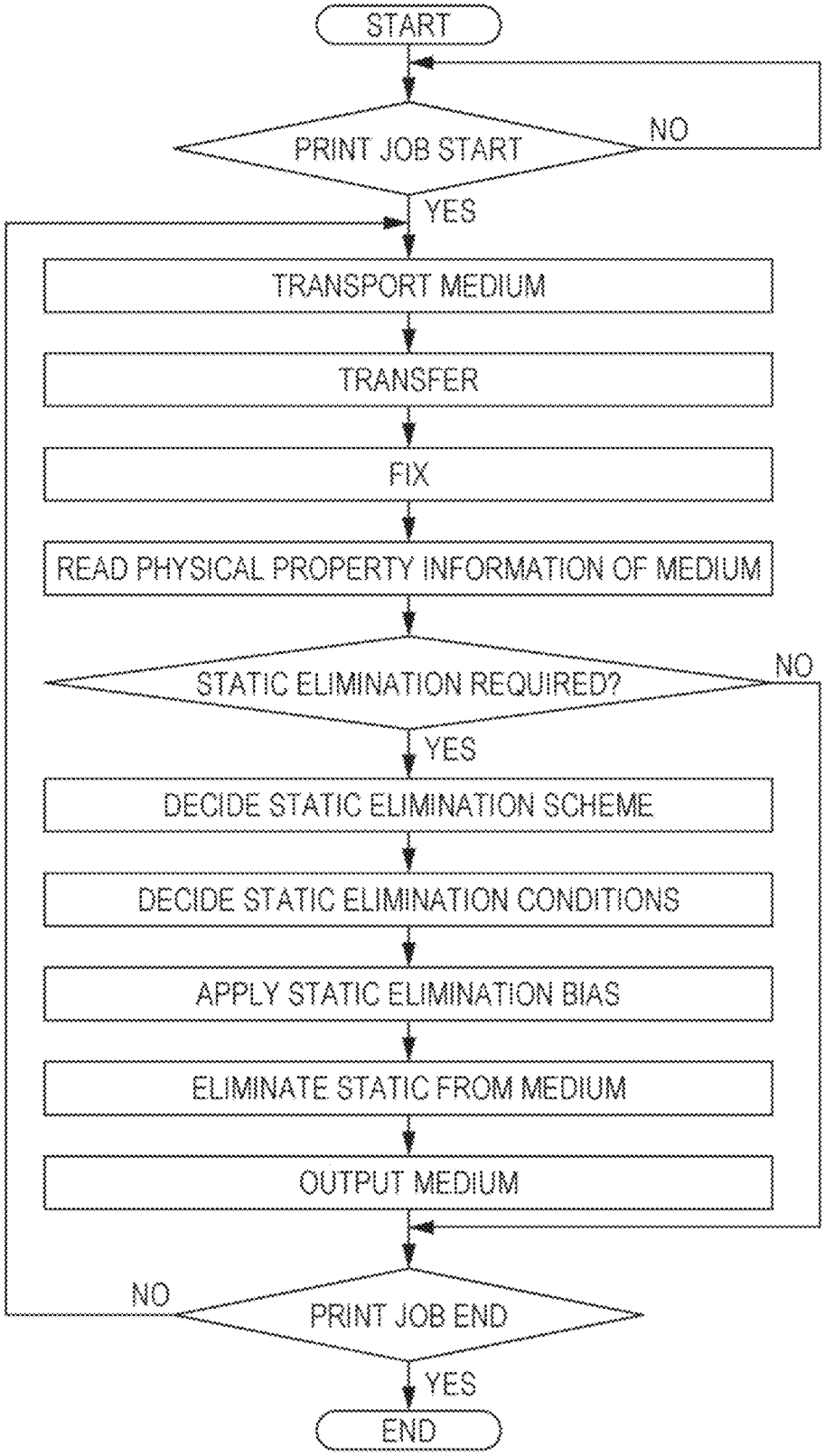
FIG. 8 is a flowchart depicting image forming control processing of the image forming device according to exemplary embodiment 1.

For example, in a case where the medium S has a high resistance similar to a resin film, for the static elimination scheme, the contact-type static eliminator 101 and the non-contact-type static eliminator 102 are both used as depicted in FIG. 9A, and the static elimination biases Vd1 and Vd2 decided as static elimination conditions are each applied as depicted in FIG. 8.

Figure 10:
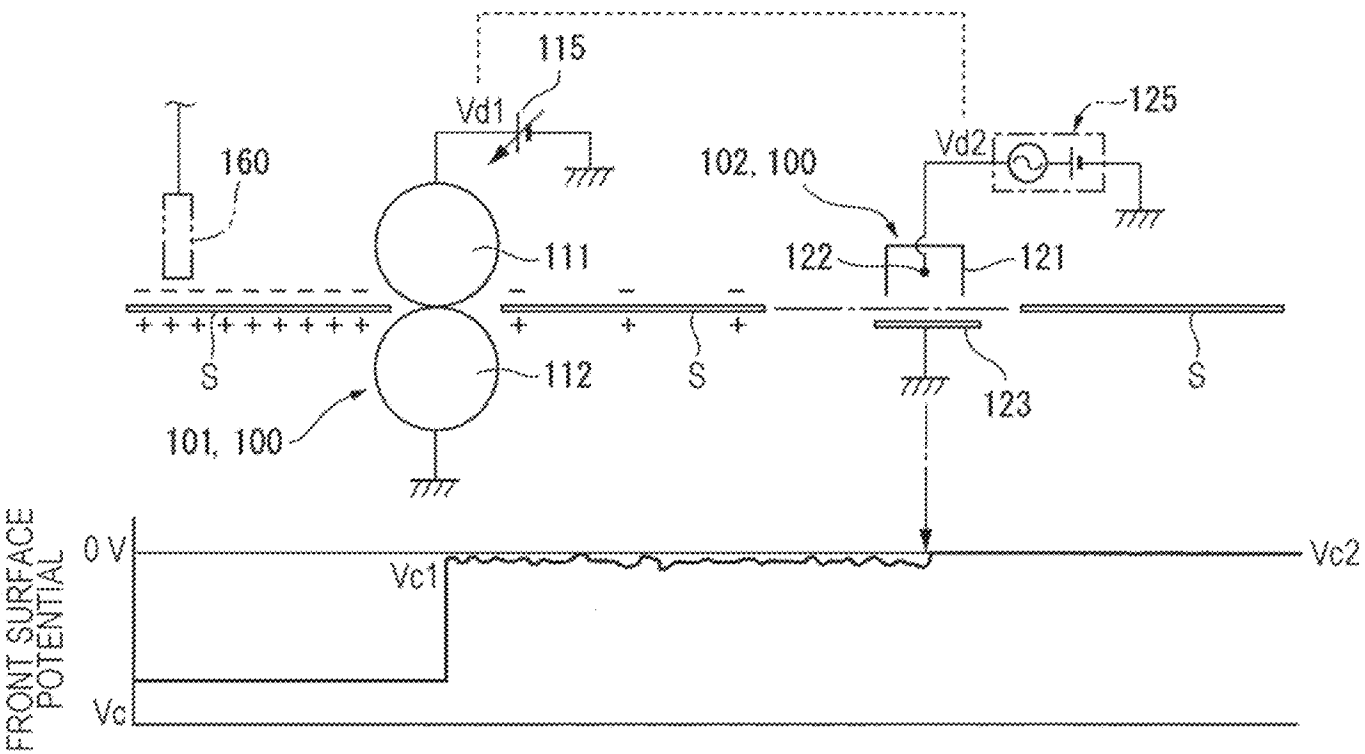
FIG. 10 is an explanatory diagram schematically depicting a static elimination operation carried out by the static elimination device in exemplary embodiment 1.

In this state, as depicted in FIGS. 8 and 10, the front surface of the medium S is charged by a negative charge e− by the second transfer device 50, and the rear surface of the medium S is charged by a positive charge e+ due to dielectric polarization; however, first, static elimination processing by the contact-type static eliminator 101 is carried out, and the front surface potential Vc of the medium S is reduced by the majority thereof in terms of absolute value to become Vc1. However, at this stage, there is a large amount of variation in the front surface potential Vc1 of the medium S.

Then, the medium S having passed through the contact-type static eliminator 101 is next subjected to static elimination processing by the non-contact-type static eliminator 102, and the front surface potential of the medium S reaches Vc2 (substantially 0) from Vc1. At this stage, the front surface potential Vc2 of the medium S is subjected to static elimination in a uniform manner.

In particular, in the present example, when the static elimination power of the contact-type static eliminator 101 is increased, there is an increase in the variation in the charging potential of the medium S after static elimination processing by the contact-type static eliminator 101 has finished, and therefore it is desirable that the static elimination power of the non-contact-type static eliminator 102 be increased.

Furthermore, in a case where the medium S has an intermediate resistance, for the static elimination scheme, only the non-contact-type static eliminator 102 is used, the static elimination bias Vd2 decided as the static elimination condition is applied, and static elimination processing by the non-contact-type static eliminator 102 is carried out, as depicted in FIG. 9A. At such time, the front surface potential of the medium S is subjected to static elimination from Vc to Vc2 (substantially 0). It should be noted that, in the present example, since the contact-type static eliminator 101 is not used, in the case of the mode depicted in FIGS. 5B and 5C for example, the static elimination rollers 111 and 112 are arranged in positions retracted from the medium S.

In addition, in a case where the medium S has a low resistance, as depicted in FIG. 9A, for the static elimination scheme, neither of the contact-type static eliminator 101 and the non-contact-type static eliminator 102 is used and static elimination processing is not carried out; however, the front surface potential of the medium S is naturally subjected to static elimination.

—Static Elimination Roller Structure of the Contact-Type Static Eliminator—

Figure 11A:
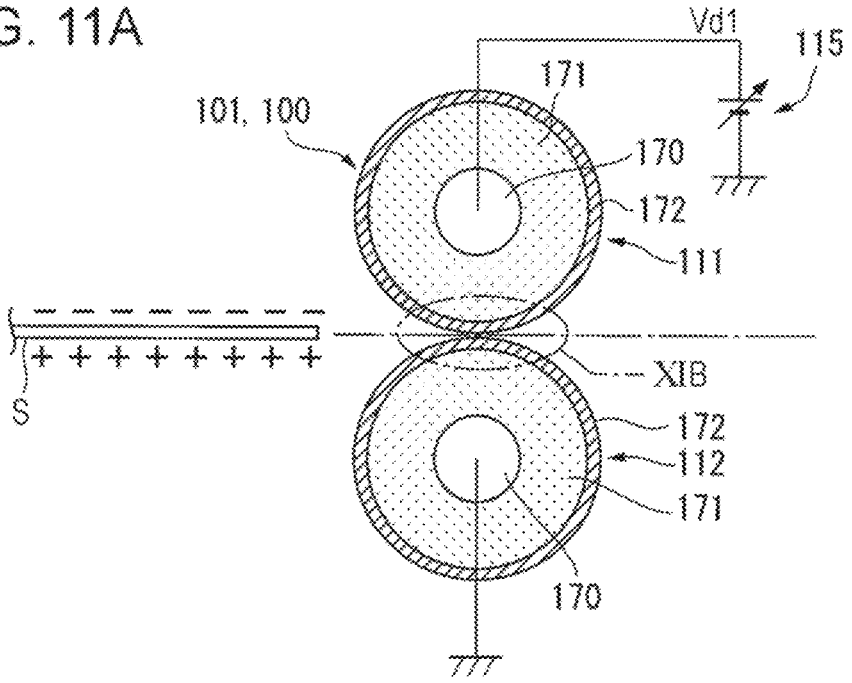
FIG. 11A is an explanatory diagram depicting the structure of static elimination rollers having a paired structure of the contact-type static eliminator according to exemplary embodiment 1.
Figure 11B:
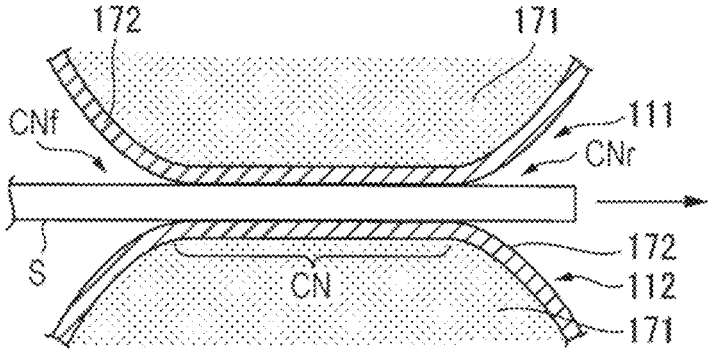
FIG. 11B is an explanatory diagram depicting the contact state with a medium brought about by the static elimination rollers having a paired structure in section XIB in FIG. 11A.

As depicted in FIG. 11, in the present example, the static elimination rollers 111 and 112 both have a configuration in which an elastic layer 171 obtained by mixing carbon black or the like with urethane foam rubber or EPDM covers the periphery of a metal shaft 170, and the front surface of the elastic layer 171 is covered by a protective layer 172 such as fluororesin, for example. Then, the static elimination bias Vd1 from the static elimination power source 115 is applied to a metal shaft 170.

In the present example, the Asker C hardness of the elastic layer 171 is preferably greater than or equal to approximately 50 degrees and less than or equal to approximately 90 degrees in view of the static elimination characteristics, and is more preferably greater than or equal to approximately 60 degrees and less than or equal to approximately 80 degrees. Here, the Asker C hardness refers to the rebound hardness when the load is 200 g, and is measured in conformance with JIS-K7312 and JIS-56050 using a de facto standard Asker C hardness tester for measuring the hardness of soft rubber, sponge, and so forth manufactured by Kobunshi Keiki Co., Ltd.

According to the present exemplary embodiment, the static elimination rollers 111 and 112 both have the elastic layer 171, and therefore make contact in the contact region CN in the axial direction with both surfaces of the medium S when the medium S is nipped and transported. Therefore, even if at least one of the static elimination rollers 111 and 112 is arranged at an incline with respect to the axial direction, as long as that angle of inclination is very small, the contact state with the front surface of the medium S is maintained between the static elimination rollers 111 and 112. Therefore, in spaces CNf and CNr before and after the contact region CN with the medium S between both static elimination rollers 111 and 112, a corona discharge is carried out in a stable manner between the static elimination roller 111 and the front surface of the medium S.

Figure 11C:
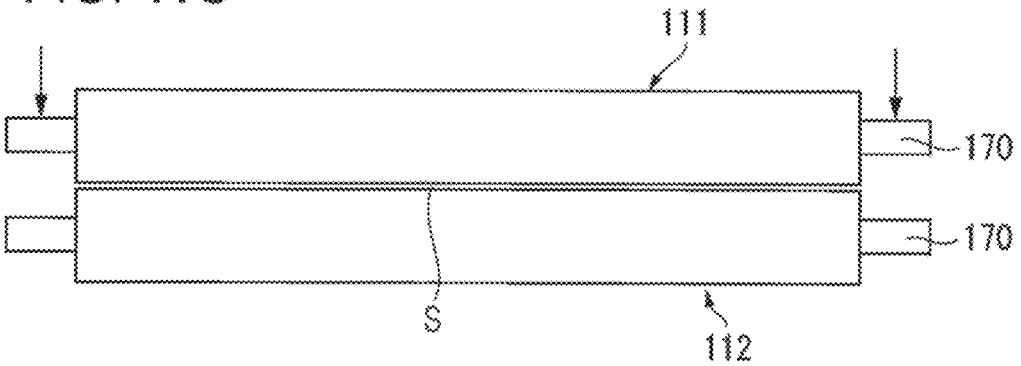
FIG. 11C is an explanatory diagram depicting the contact state with the medium in the axial direction of the static elimination rollers having a paired structure.

In addition, as depicted in FIG. 11C, the static elimination rollers 111 and 112 make contact in the contact region CN in the axial direction with both surfaces of the medium S due to elastic deformation of the elastic layer 171, and therefore there is little concern of the static elimination rollers 111 and 112 not making contact with the front surface of the medium S in a portion in the axial direction. Therefore, when the static elimination rollers 111 and 112 nip and transport the medium S, a non-contact section does not occur in a portion of the contact region CN extending in the axial direction, the contact state with the medium S in the axial direction is maintained in the contact region CN between the static elimination rollers 111 and 112, and there is no concern of static elimination irregularities occurring in the axial direction.

<Example Non-Contact Arrangement of Static Elimination Rollers>

Figure 12A:
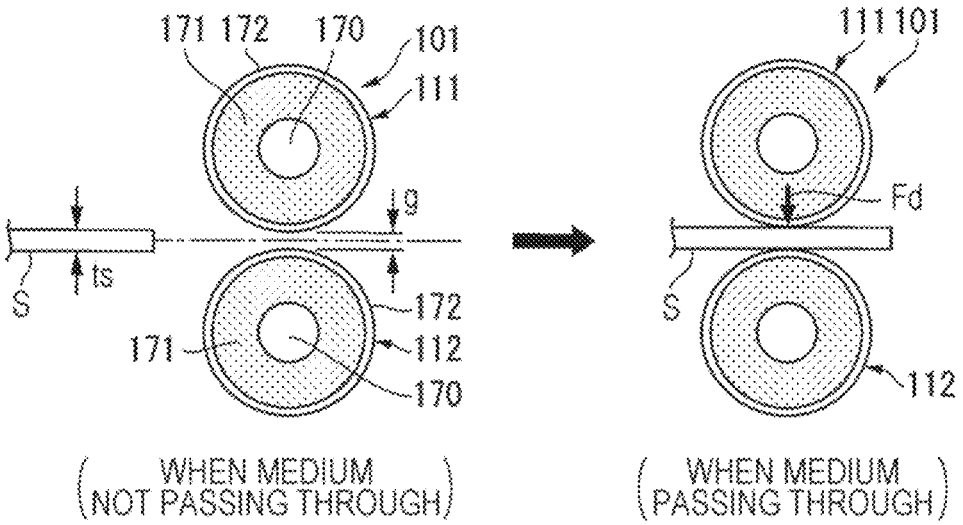
FIG. 12A is an explanatory diagram depicting the significance and the contact pressure of the contact with the medium brought about by the static elimination rollers having a paired structure.

Furthermore, in the present exemplary embodiment, the static elimination rollers 111 and 112 are arranged in contact even when the medium S is not passing through; however, the present disclosure is not necessarily restricted thereto, and the static elimination rollers 111 and 112 may be arranged in a non-contact manner when the medium S is not passing through, as depicted in FIG. 12A. However, it is sufficient for a gap g between the static elimination rollers 111 and 112 to be set to be narrower than a thickness is of the medium S, and it is acceptable for the gap g to be selected as appropriate provided that, when the medium S passes between the static elimination rollers 111 and 112, the static elimination rollers 111 and 112 make contact with both surfaces of the medium S, a contact pressure Fd in the contact region CN with respect to the medium S ensures the transportability of the medium S brought about by the static elimination rollers 111 and 112, and the static elimination operation on the medium S is not impaired.

In the present example, the contact pressure Fd with respect to the medium S brought about by the static elimination rollers 111 and 112 is selected to be lower than the contact pressure in the second transfer area TR of the second transfer device 50. Therefore, when the medium S passes through the contact-type static eliminator 101, there is no risk of the image formed on the medium S being unnecessarily damaged, and the transportability and static elimination operability with respect to the medium S are satisfactorily maintained.

<Volume Resistivity of Elastic Layer>

Furthermore, the volume resistivity of the elastic layer 171 is preferably greater than or equal to approximately $10^4$ Ω·cm and less than or equal to approximately $10^{10}$ Ω·cm, more preferably greater than or equal to approximately $10^3$ Ω·cm and less than or equal to approximately $10^9$ Ω·cm, even more preferably greater than or equal to approximately $10^6$ Ω·cm and less than or equal to approximately $10^8$ Ω·cm, and most preferably remains within this range even if there is an environmental change.

Figure 12B:
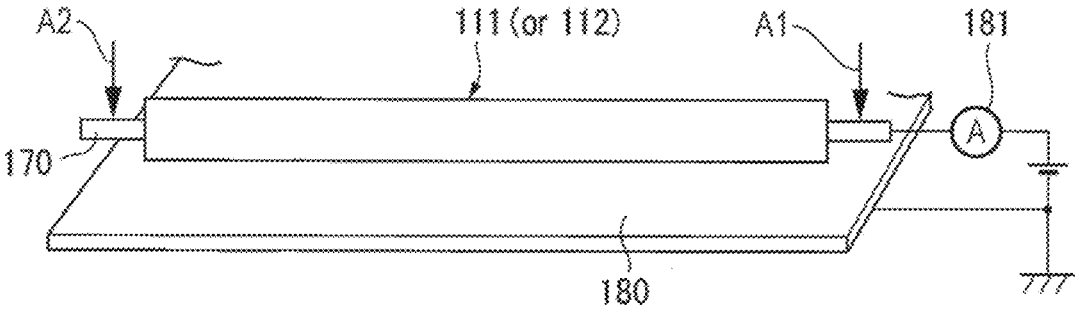
FIG. 12B is an explanatory diagram depicting an example of a method for measuring the volume resistivity of the static elimination rollers.

Here, it is acceptable for the method for measuring the volume resistivity to be selected as appropriate, and an example thereof is depicted in FIG. 12B.

In the drawing, a conductive roller which is either of the static elimination rollers 111 and 112 is placed on a metal plate 180, and, in a state where a predetermined load (500 g, for example) is applied in the locations of arrows A1 and A2 at both ends of the metal shaft 170 that is a core bar of the conductive roller, and in an environment having a temperature of 22° C. and a humidity of 55 RH %, a predetermined applied voltage (1000 V, for example) is applied between the metal shaft 170 which is a core bar and the metal plate 180, the current value I(A) after 10 seconds is read by a current measuring instrument 181, and a volume resistance R(Q) is calculated according to the expression "R=V/I". This measurement and calculation are carried out at four points by causing the conductive roller, which is either of the static elimination rollers 111 and 112, to rotate 90° at time in the circumferential direction, and the average value therefor is taken as the volume resistance R of the conductive roller. Then, from the volume resistance R of the conductive roller, the volume resistivity ρv(Ω·cm) of the elastic layer 171 is calculated according to the expression below.

$$\rho v = D \times W \times R / t$$

In the expression above, D(cm) represents the axial length of the conductive roller, W(cm) represents the contact (nip) width between the conductive roller and an electrode (corresponding to the metal plate 180), and t(cm) represents the thickness of the elastic layer. Volume resistivity is calculated according to the expression above.

<Static Elimination Bias Control for Contact-Type Static Eliminator>

In the present exemplary embodiment, it is acceptable for the contact-type static eliminator 101 to use a static elimination bias Vd1 that is determined in advance; however, since physical property values and charging amounts for mediums S vary considerably, a scheme is desirable in which the static elimination bias Vd1 is controlled according to the front surface potential of the medium S.

Figure 13A:
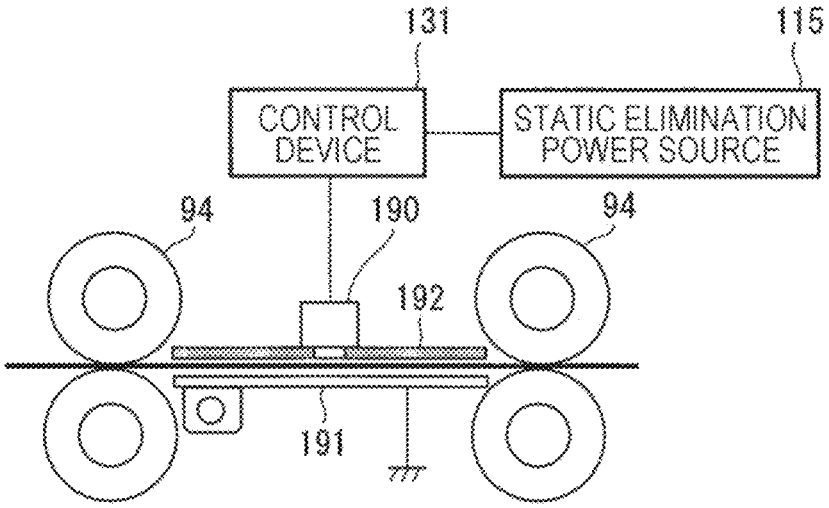
FIG. 13A is an explanatory diagram depicting an example of the installation of a surface potential meter that measures the front surface potential of a medium.
Figure 13B:
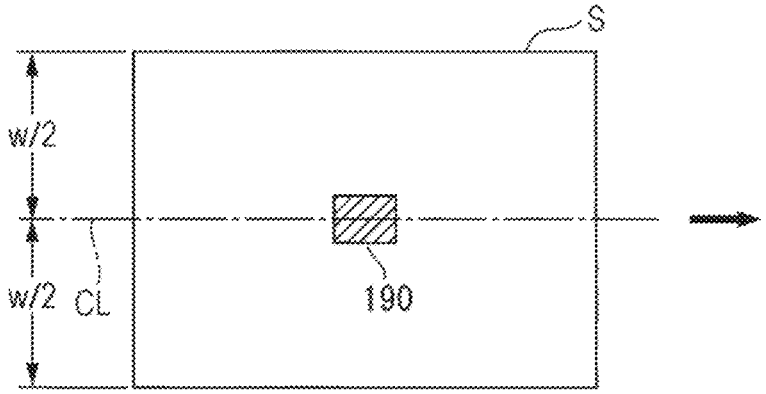
FIG. 13B is an explanatory diagram depicting the positional relationship between the surface potential meter and the medium.

In the present example, it is sufficient for a surface potential meter 190 to be installed in an arbitrary location between the transport rollers 94, for example, and the front surface potential of the medium S to be measured in a non-contact manner, as depicted in FIG. 13A. Here, an ESV (abbreviation of electrostatic voltmeter) that uses static electricity measurements, for example, is used as the surface potential meter 190. In the present example, as depicted in FIGS. 13A and 13B, the surface potential meter 190 is installed in a location corresponding to a center line CL in the width direction intersecting the transport direction of the medium S (corresponding to a location that is ½ of the width direction dimension w of the medium S), an opposing electrode 191 that is grounded is provided in a location opposing the surface potential meter 190, and the medium S passes through while making contact with the opposing electrode 191. It should be noted that, in FIG. 13A, the reference number 192 indicates a support bracket for the surface potential meter 190. Also, as a measurement value of the surface potential meter 190, for example, the average value of results measured within a predetermined time may be adopted, or the average value of results measured at multiple points may be adopted. Alternatively, measurements may be carried out using another calculation method.

Figure 14:
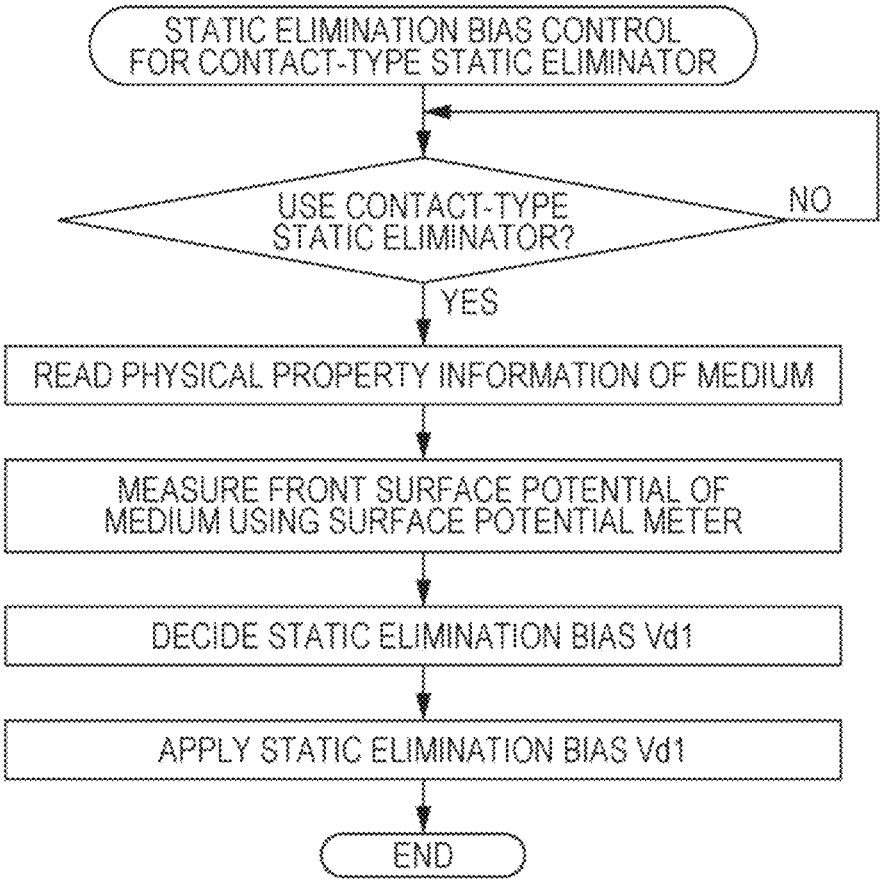
FIG. 14 is a flowchart depicting an example of static elimination bias control for the contact-type static eliminator.

FIG. 14 is a flowchart for carrying out static elimination bias control for the contact-type static eliminator.

In the drawing, it is checked whether or not it is a static elimination condition to use the contact-type static eliminator 101, and in the case where the contact-type static eliminator 101 is to be used, the physical property information of the medium S is read, and in addition the front surface potential of the medium S is measured by the surface potential meter 190.

It is then sufficient for the static elimination bias Vd1 to be decided and the static elimination bias Vd1 to be applied to the static elimination roller 111.

<Layout of the Surface Potential Meter>

Regarding the layout of the surface potential meter 190, the surface potential meter 190 may be installed upstream or downstream in the transport direction of the medium S from the contact-type static eliminator 101. Here, in a mode in which the surface potential meter 190 is installed further upstream in the transport direction of the medium S than the contact-type static eliminator 101, it is possible to perform feedback control on the static elimination bias Vd1 of the contact-type static eliminator 101 from the first sheet of the medium S.

In contrast, in a mode in which the surface potential meter 190 is installed further downstream in the transport direction of the medium S than the contact-type static eliminator 101, after the front surface potential of the first sheet of the medium S has been measured for a test, it is possible to perform feedback control on the static elimination bias Vd1 of the contact-type static eliminator 101 for the second sheet of the medium S and thereafter. However, since the front surface potential of the medium S after static elimination by the contact-type static eliminator 101 is measured, it is not necessary for a large potential to be measured, and accordingly it is necessary for the surface potential meter 190 to be reduced in size.

It should be noted that, in the present example, the measurement result of the surface potential meter 190 is not used to control the static elimination bias Vd2 of the non-contact-type static eliminator 102. This is based on it being acceptable for the static elimination bias Vd2 of the non-contact-type static eliminator 102 to intentionally not be controlled since the static elimination potential level brought about by the non-contact-type static eliminator 102 is small compared to the static elimination potential level brought about by the contact-type static eliminator 101.

<Method for Deciding Static Elimination Bias Vd1>

It is acceptable for the method for deciding the static elimination bias Vd1 implemented by the contact-type static eliminator 101 to be selected as appropriate; however, in the present example, it is desirable that the static elimination bias Vd1 be selected for charge to be eliminated from the medium S such that the distribution between positive charge and negative charge at the front surface after static elimination becomes non-uniform compared to before static elimination. In particular, in the present example, it is desirable that the medium S be subjected to static elimination in such a way that in the distribution of front surface charge after static elimination there is an increase in the proportion of the charge that was dominant before static elimination.

Figure 15A:
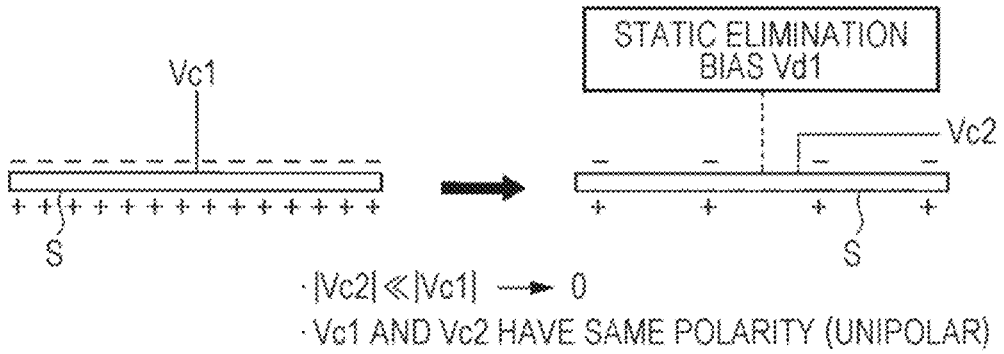
FIG. 15A is an explanatory diagram depicting a change in the charging of a medium that accompanies the static elimination operation carried out by the contact-type static eliminator.

Here, as depicted in FIG. 15A, it is assumed that the front surface potential of the medium S before static elimination is Vc1 and that negative charge was dominant before static elimination.

At such time, as for the static elimination bias Vd1 of the contact-type static eliminator 101, when the front surface potential of the medium S after static elimination is taken as Vc2, it is sufficient for Vd1 to be selected such that |Vc2| attenuates to a value close to 0 and Vc2 has the same polarity as that of Vc1.

Figure 15B:
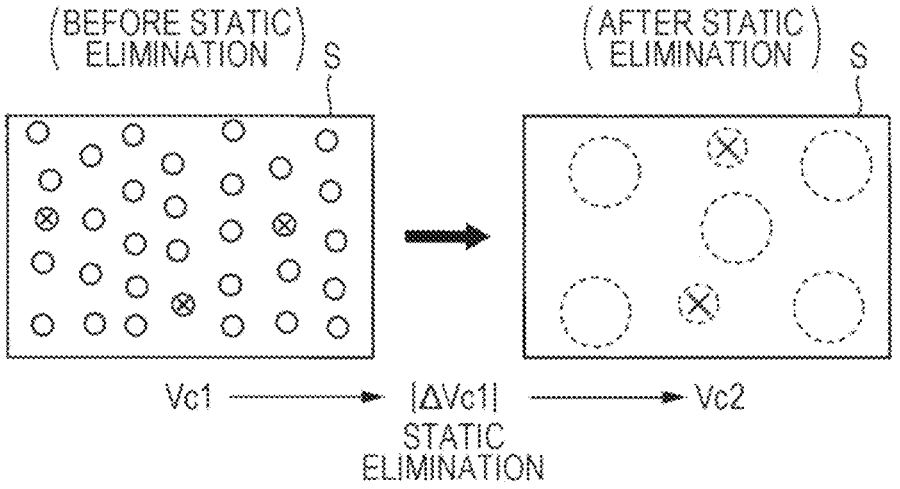
FIG. 15B is an explanatory diagram schematically depicting the charged state of the medium front surface before and after the static elimination carried out by the contact-type static eliminator.

In this way, when selecting the static elimination bias Vd1, as depicted in FIG. 15B, the charge distribution of the medium S before static elimination had a uniform distribution in which negative charge (indicated in the drawing by white circles) was dominant compared to positive charge (indicated in the drawing by x marks in white circles) and the front surface potential was Vc1; in contrast, in the charge distribution of the medium S after static elimination, negative charge and positive charge are distributed in a non-uniform manner such that the proportion of negative charge increases, and static is eliminated by |ΔVc1| such that the front surface potential attenuates to Vc2. It should be noted that, regarding the charge distribution of the medium S after static elimination, the white circle portions having dotted lines indicate regions of attenuated negative charge, and the portions in which x marks have been added to white circles having dotted lines indicate regions of positive charge.

A reason for having selected this kind of static elimination pattern is so as to avoid Vc2 having a potential of the opposite polarity to the potential from before static elimination, rather than Vc2 being a value close to 0. There being an increase in the proportion of positive charge which is different from the negative charge that was dominant in the medium S before static elimination, for example, means that the static elimination bias Vd1 is too strong.

<Selecting the Initial Value for the Static Elimination Bias of the Contact-Type Static Eliminator>

As previously mentioned, when controlling the static elimination bias Vd1 of the contact-type static eliminator 101, it is desirable that the initial value for the optimum static elimination bias Vd1 be selected with respect to the front surface potential of the medium S. However, to select the initial value for the static elimination bias Vd1, it is necessary to apply multiple candidate static elimination biases Vd1 to the medium S for testing a predetermined charged state, and to measure, using the surface potential meter 190, the degree of attenuation in the front surface potential of the medium S brought about by each static elimination bias Vd1.

Figure 16A:
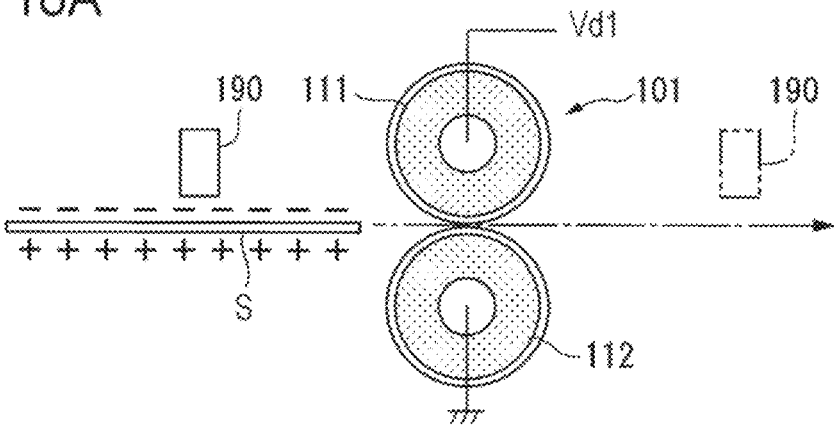
FIG. 16A is an explanatory diagram depicting an example of the installation of a surface potential meter with respect to the contact-type static eliminator.

Therefore, in the present example, as depicted in FIG. 16A, it is necessary for a mode to be adopted in which the surface potential meter 190 is installed further downstream in the transport direction of the medium S than the contact-type static eliminator 101 (corresponding to a mode in which the surface potential meter 190 is installed in the location indicated by the two-dot chain line in the drawing).

Figure 16B:
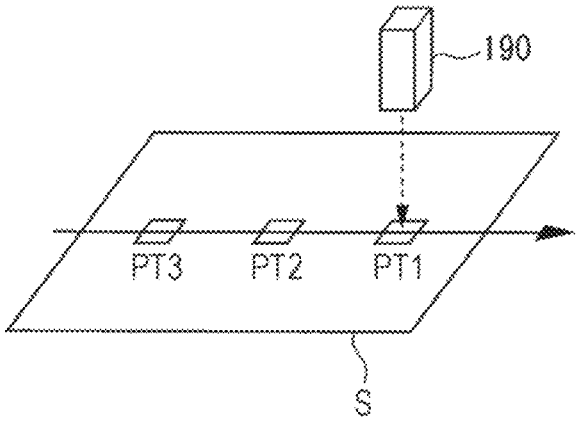
FIG. 16B is an explanatory diagram depicting an example of a method for selecting an initial optimum value for a static elimination bias using the surface potential meter installed further downstream in the medium transport direction than the contact-type static eliminator.
Figure 16C:
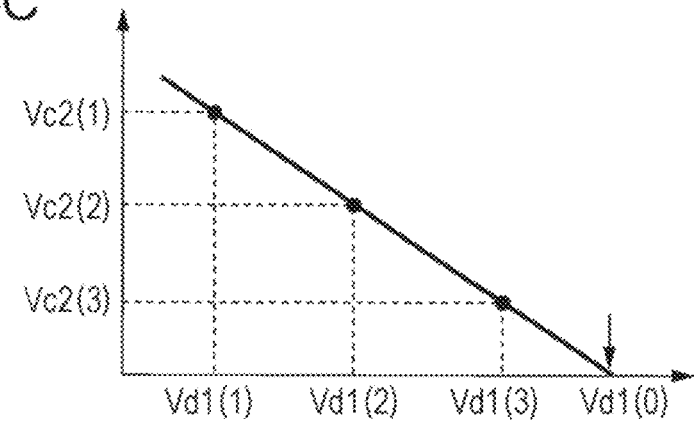
FIG. 16C is an explanatory diagram depicting an example of a measurement line according to this method.

In the present example, as depicted in the example in FIG. 16B, different static elimination biases Vd1 (specifically Vd1(1) to Vd1(3)) are applied to patches PT1 to PT3 (all having front surface potentials of similar charging conditions) at, for example, three locations of a test medium S, after which the front surface potential remaining on the medium S is measured. When this is plotted with the front surface potential remaining on the medium S being taken as Vc2 (specifically Vc2(1) to Vc2(3)) with respect to each static elimination condition, for example, it is apparent that the front surface potential Vc2 remaining on the medium S decreases as the static elimination bias Vd1 increases, as indicated by the measurement line in FIG. 16C. At such time, it is sufficient for the static elimination bias Vd1 (specifically Vd1(0)) with which the remaining front surface potential Vc2 reaches approximately 0 to be a linear approximation from the measurement line of FIG. 16C.

A static elimination bias Vd1 (Vd1(0)) that is optimum in terms of performing static elimination with respect to the predetermined front surface potential Vc1 of the medium S is thereby calculated. Thus, based on the initial value of the static elimination bias Vd1, it is possible to select the static elimination bias Vd1 that is optimum in terms of performing static elimination with respect to an arbitrarily charged front surface potential Vc1. However, it is not absolutely necessary to perform linear approximation from the measurement line, and any other scheme may be adopted provided that it is a scheme with which an initial value for the static elimination bias Vd1 is obtained from multiple front surface potentials remaining on the medium S after applying different static elimination biases Vd1.

—Static Elimination Parameters of the Non-Contact-Type Static Eliminator—

Figure 17A:
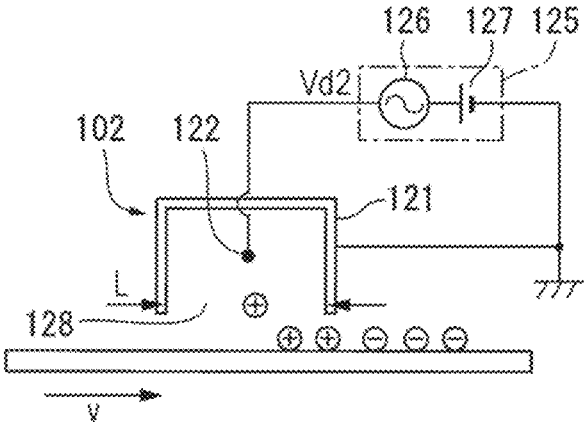
FIG. 17A is an explanatory diagram schematically depicting the movement of charge from a discharge wire that accompanies a corona discharge produced by the non-contact-type static eliminator.

In the present example, as depicted in the example in FIG. 17A, the static elimination power source 125, which applies the static elimination bias Vd2 made up of an alternating-current voltage component superposed by a direct-current voltage component, is connected between the discharge wire 122 and the static elimination housing 121 in the non-contact-type static eliminator 102.

In the present example, since the static elimination bias Vd2 including an alternating-current voltage component is applied between the discharge wire 122 and the static elimination housing 121, positive ions (+) and negative ions (−) produced by a corona discharge are generated in a mixed manner from the periphery of the discharge wire 122. In the present example, the positive ions (+) and the negative ions (−) are alternately generated in each half period of the frequency f (Hz) of the static elimination bias Vd2.

Here, examining the static elimination parameters of the non-contact-type static eliminator 102, if the frequency f of the static elimination bias Vd2 increases, it is surmised that accordingly the generation period of the positive ions (+) and the negative ions (−) becomes quicker, and the amount of ions generated increases.

Furthermore, focusing on the transport speed v of the medium S, in a case where the transport speed v of the medium S is quick, the ion balance deteriorates if the ion generation period is not shortened (increasing the ion frequency).

In the present example, taking this into consideration, focusing on a static elimination parameter f/v obtained using the frequency f of the static elimination bias Vd2 that includes an alternating-current voltage component, in accordance with an evaluation performed using a method for evaluating sticking of the medium S described later, when selecting a range for the optimum static elimination parameter f/v, it is established that a mode satisfying the expression below is desirable.

$$f/v \geq 0.8 \quad \text{(expression 1)}$$

In expression 1, it is particularly desirable that the expression below be satisfied.

$$f/v \geq 1.5 \quad \text{(expression 2)}$$

In addition, in the present example, an opening 128 in the static elimination housing 121 is formed having an opening width L in the transport direction of the medium S, as depicted in FIG. 17A.

Here, the opening width L of the opening 128 in the static elimination housing 121 regulates the ion emission region toward the medium S, the ion emission region narrows if the opening width L is narrow, and conversely the ion emission region widens if the opening width L is wide. Consequently, it is possible to adjust the ion amount per unit length by the relationship between the ion amount and the ion emission region. Specifically, in the case where the opening width L is long, there is concern that the ion balance may deteriorate across the entire opening 128 if the ion generation period (ion frequency) is not shortened.

In this way, it is surmised that the opening width L of the static elimination housing 121 has an effect on the static elimination action.

Taking this point into consideration, when selecting f/v*L as a static elimination parameter, it is established that a mode satisfying the expression below is desirable.

$$f/v*L \geq 30 \quad \text{(expression 3)}$$

It should be noted that the reasons for adopting expressions 1 to 3 will be described in detail using example 4 described later.

Furthermore, in the present example, if the opening width L is narrow, it is apparent that there is a risk of the static elimination being insufficient if a high frequency of a predetermined level or greater is not used. It is estimated that this is because there is a reduction in the amount of ions received per unit length of the medium S that passes through the non-contact-type static eliminator 102 due to the ion emission region becoming narrow. On the other hand, due to the ion emission region being wide when the opening width L is large, there is an increase in the amount of ions received per unit length of the medium S that passes through the non-contact-type static eliminator 102. Thus, compared to the case where the opening width L is narrow, charge is sufficiently eliminated even with a lower frequency.

—Corona Discharge Characteristics According to the Non-Contact-Type Static Eliminator—

In the present example, the static elimination bias Vd2 applied to the discharge wire 122 is an alternating-current voltage component Vac (provided with a peak-to-peak voltage Vpp and the frequency f) superposed by a direct-current voltage component Vdc (a positive voltage is used in the present example), as depicted in FIG. 17A. At such time, a corona discharge occurs in the periphery of the discharge wire 122, and the voltage-current characteristics of the corona discharge are depicted in FIG. 17B.

Figure 17B:
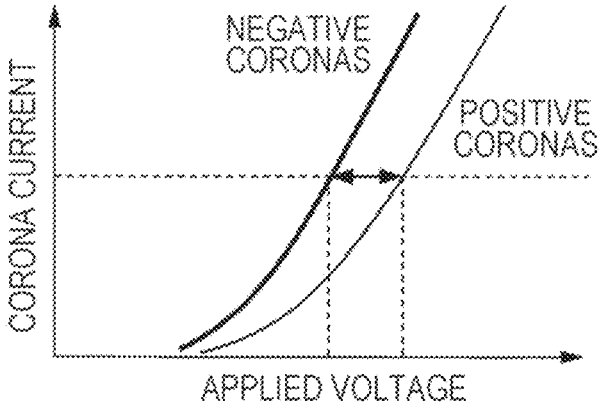
FIG. 17B is an explanatory diagram schematically depicting an example of the voltage-current characteristics of the corona discharge.

In FIG. 17B, the horizontal axis indicates the applied voltage and the vertical axis indicates the corona discharge current, and the absolute value of the applied voltage with which negative coronas (corresponding to negative ions (−)) are generated is lower than that of the applied voltage with which positive coronas (corresponding to positive ions (+)) are generated.

Figure 17C:
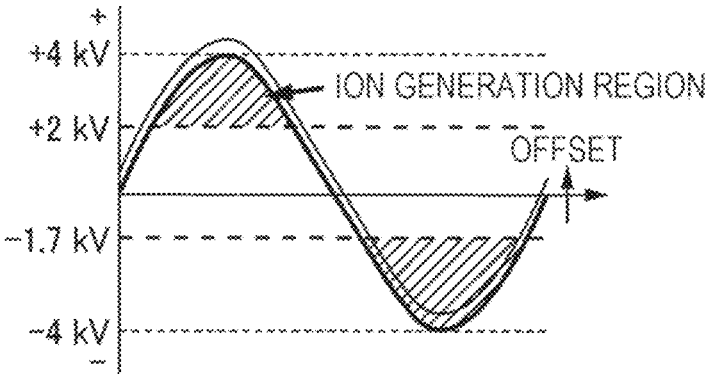
FIG. 17C is an explanatory diagram schematically depicting the ion balance of an AC corotron (using an alternating-current discharge bias)

Here, in the present example, the direct-current voltage component Vdc is superposed on the alternating-current voltage component Vac in the static elimination bias Vd2, and therefore there is a change in which the alternating-current voltage component Vac is offset to the positive side by an amount commensurate to the direct-current voltage component Vdc, as indicated from the thicker line to the thinner line in FIG. 17C.

At such time, assuming that Vpp is ±4 kV, Vdc is +0.3 kV, the positive corona discharge starting voltage is +2 kV, and the negative corona discharge voltage is −1.7 kV, for example, the diagonal line regions in FIG. 17C are ion generation regions, positive coronas (positive ions (+)) are generated in the ion generation region of 2 kV or more, and negative coronas (negative ions (−)) are generated in the ion generation region of −1.7 kV or less. Therefore, compared to the case where the direct-current voltage component Vdc is not superposed, the balance between the amount of positive ions and negative ions generated becomes uniform.

—Static Elimination Action of the Non-Contact-Type Static Eliminator—

Figure 18A:
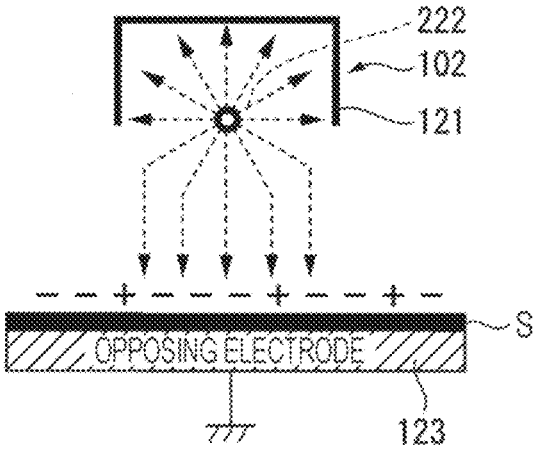
FIG. 18A is an explanatory diagram schematically depicting an example of the behavior of generated ions in a mode where the non-contact-type static eliminator has an opposing electrode.

In the present example, in the non-contact-type static eliminator 102, the earth electrode 123 serving as an opposing electrode that opposes the discharge wire 122 is provided grounded, as depicted in FIG. 18A. If this kind of earth electrode 123 is provided, from among the ions generated in the periphery of the discharge wire 122, mainly positive ions (+) are drawn toward the earth electrode 123 and are supplied for eliminating the front surface charge (mainly negative charge e−) of the medium S.

Figure 18B:
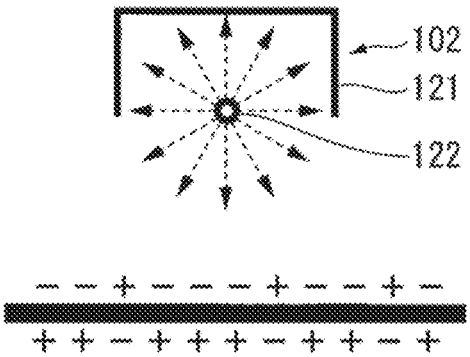
FIG. 18B is an explanatory diagram schematically depicting an example of the behavior of generated ions in a mode where there is no opposing electrode.

In contrast, as depicted in FIG. 18B, in a mode in which the earth electrode 123 serving as an opposing electrode that opposes the discharge wire 122 is not installed, ions generated in the periphery of the discharge wire 122 are merely radiated in the periphery, and are not actively drawn toward the front surface charge (mainly negative charge e−) of the medium S and supplied for static elimination.

—Comparison Between AC Static Elimination Bias and DC Static Elimination Bias—

Figure 18C:
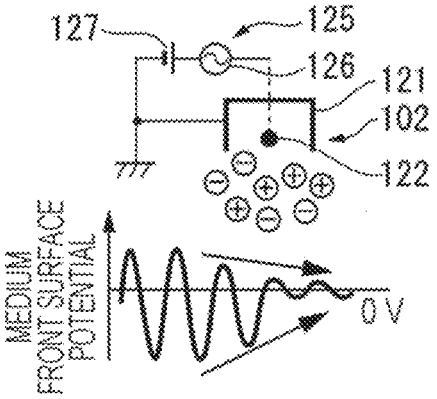
FIG. 18C is an explanatory diagram depicting the progress of static elimination for the front surface potential of a medium in a case where an AC static elimination bias is used.

In the present example, as the static elimination power source 125, the static elimination bias Vd2 is an AC static elimination bias made up of an alternating-current voltage component superposed by a direct-current voltage component, and positive ions (+) and negative ions (−) are supplied in a mixed manner for static elimination to the front surface of the medium S, as depicted in FIG. 18C. Therefore, both negative charge e− and positive charge e+ of the front surface charge of the medium S are eliminated, and the front surface potential of the medium S attenuates to approximately 0.

Figure 18D:
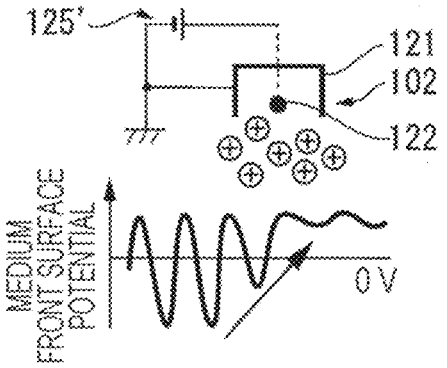
FIG. 18D is an explanatory diagram depicting the progress of static elimination for the front surface potential of a medium in a case where a DC static elimination bias is used.

In contrast, as a static elimination power source 125', assuming that a direct-current static elimination bias made up of only a direct-current voltage component is used for the static elimination bias Vd2, only positive ions (+) are generated in the periphery of the discharge wire 122 and the positive ions (+) eliminate negative charge e− on the front surface of the medium S, and negative ions (−) for eliminating positive charge e+ from among the front surface charge of the medium S are not generated and positive charge e+ on the medium S is not eliminated, as depicted in FIG. 18D.

In this way, in the present example, by adopting an AC static elimination bias, even if positive charge e+ and negative charge e− are present in a mixed manner in the front surface charge of the medium S, it is possible to eliminate both.

<Static Elimination Bias Control for Non-Contact-Type Static Eliminator>

Figure 19A:
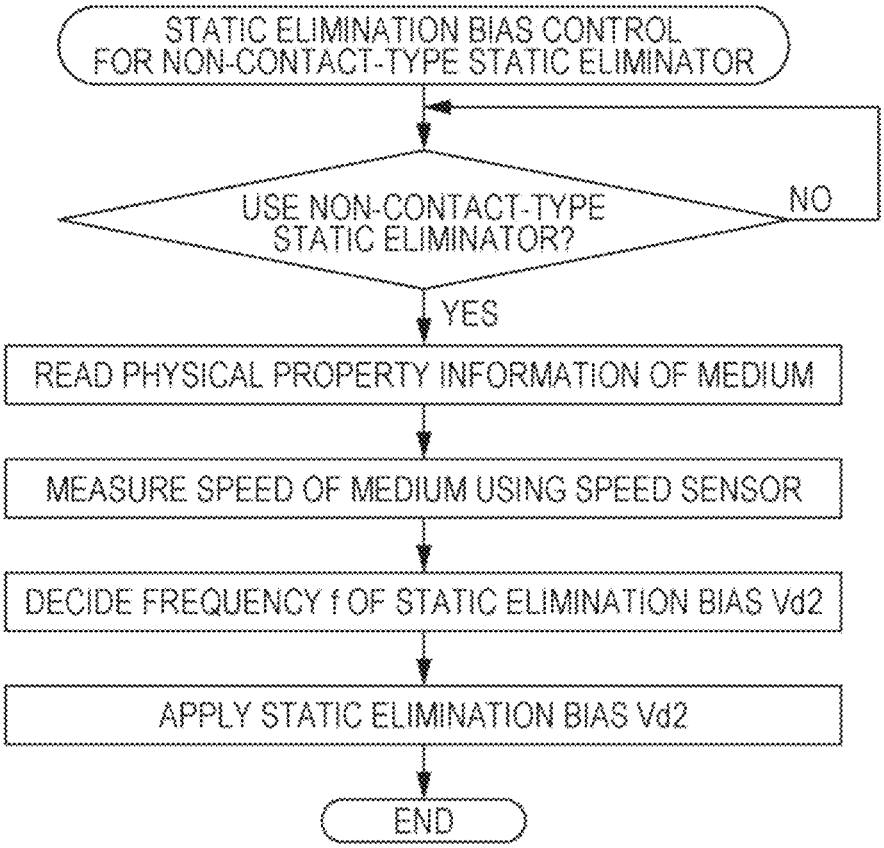
FIG. 19A is a flowchart depicting an example of static elimination bias control for the non-contact-type static eliminator.
Figure 19B:
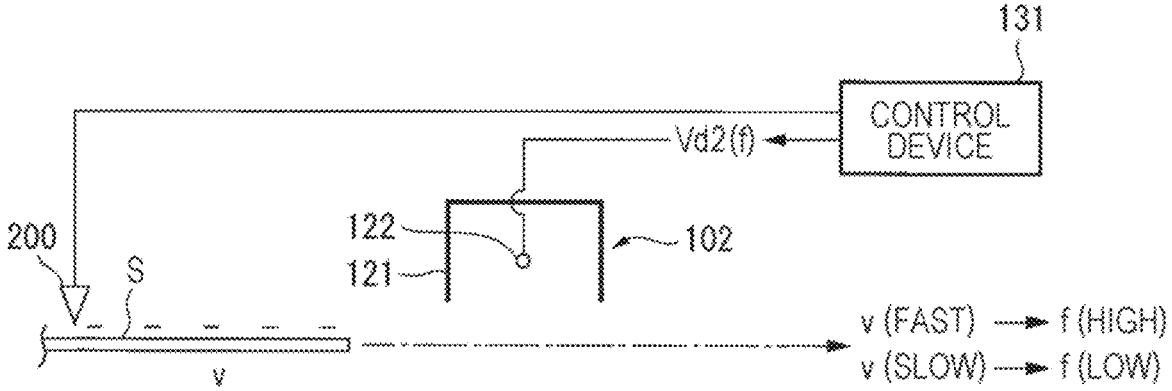
FIG. 19B is an explanatory diagram depicting an example of a method for deciding the frequency of a static elimination bias.

In the present example, in the non-contact-type static eliminator 102, static elimination parameters may be used in a fixed manner; however, in a mode in which the transport speed v of the medium S changes, it is desirable that the frequency f of the static elimination bias Vd2 be controlled according to the transport speed v of the medium S, as depicted in FIG. 19B.

That is, in the present example, a speed sensor 200 that detects the transport speed v of the medium S is provided midway along the transport path of the medium S, speed information from the speed sensor 200 is acquired by the control device 131, and the control device 131 controls the frequency f of the static elimination bias Vd2.

In the present example, a static elimination bias control program for the non-contact-type static eliminator 102 is installed in the control device 131, and the static elimination bias control processing depicted in FIG. 19A is carried out.

In FIG. 19A, the control device 131 checks whether or not it is a static elimination condition to use the non-contact-type static eliminator 102, and, in the case where the non-contact-type static eliminator 102 is to be used, reads the physical property information of the medium S, and in addition measures the transport speed v of the medium S using the speed sensor 200.

It is then sufficient for the frequency f of the static elimination bias Vd2 to be decided and the static elimination bias Vd2 to be applied to the discharge wire 122.

In the present example, for example, in a case where the transport speed v of the medium S is a speed v(fast) that is faster than a normal speed, it is sufficient for the frequency f to be set to f(high), and conversely in a case where the transport speed v of the medium S is a speed v(slow) that is slower than the normal speed, it is sufficient for the frequency f to be f(low), as depicted in FIG. 19B.

Exemplary Embodiment 2

Figure 20:
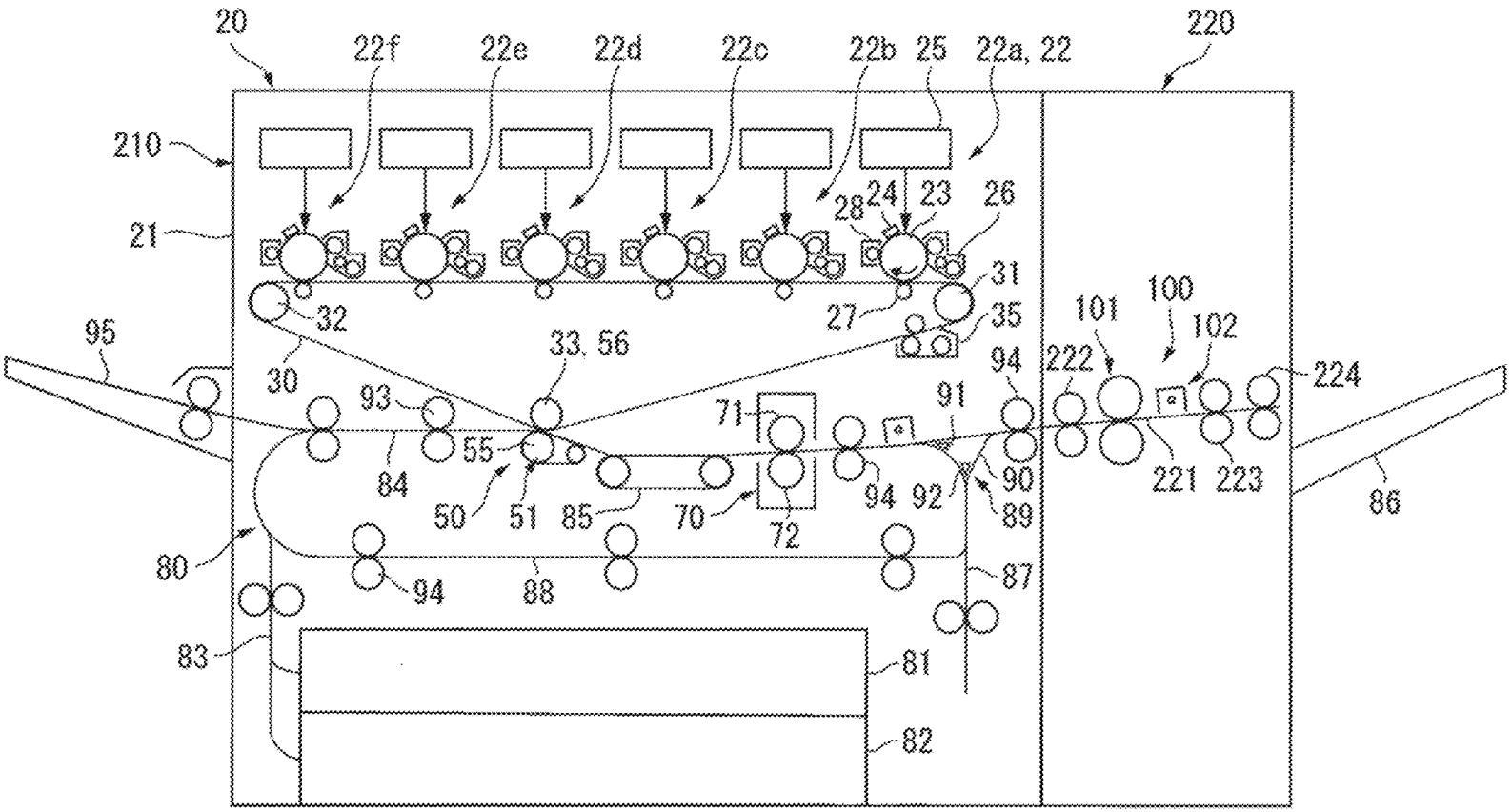
FIG. 20 is an explanatory diagram depicting a section of an image forming device according to exemplary embodiment 2.

FIG. 20 depicts the overall configuration of an image forming device according to exemplary embodiment 2.

In the drawing, the image forming device 20 includes an image forming unit 210 that has the image forming units 22 housed therein, and a static elimination unit 220 that receives and eliminates static from the medium S that is output from an exit portion of the horizontal transport path 84 of the image forming unit 210, which is different from the image forming device according to exemplary embodiment 1. The image forming unit 210 incorporates the elements (the image forming units 22, the intermediate transfer body 30, the fixing device 70, and the medium transport system 80) other than the static elimination device 100, with the static elimination device 100 being incorporated in the static elimination unit 220.

It should be noted that constituent elements similar to those in exemplary embodiment 1 are denoted by reference numbers similar to those in exemplary embodiment 1 and detailed descriptions thereof are omitted here.

Figure 21:
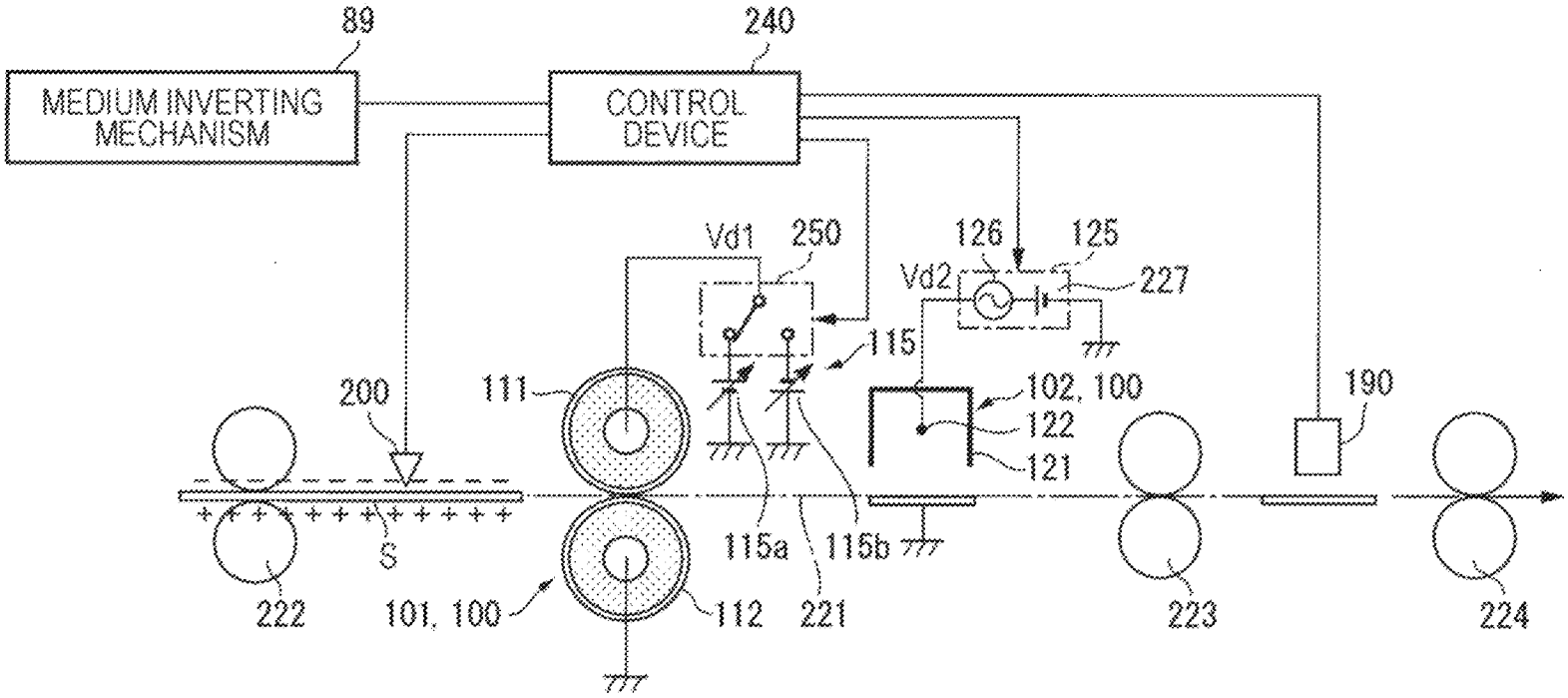
FIG. 21 is an explanatory diagram depicting an example configuration in the vicinity of a static elimination unit of the image forming device according to exemplary embodiment 2.

In the present example, as depicted in FIGS. 20 and 21, the static elimination unit 220 has a horizontal transport path 221 along which the medium S that is output from the image forming unit 210 is transported in a substantially horizontal direction, an appropriate number of transport rollers 222 to 224 are installed on the horizontal transport path 221, and in addition the medium output receiver 86 is provided at the exit location of the horizontal transport path 221. Furthermore, within the horizontal transport path 221, in the region between the transport rollers 222 and 223, as the static elimination device 100, the contact-type static eliminator 101 is installed, and also the non-contact-type static eliminator 102 is installed downstream in the transport direction of the medium S from the contact-type static eliminator 101.

In the present example, a control device 240 is also incorporated within the static elimination unit 220, the surface potential meter 190 that measures the front surface potential of the medium S is installed in the region between the transport rollers 223 and 224, for example, and the speed sensor 200 is installed in the region between the transport roller 222 and the contact-type static eliminator 101 on the horizontal transport path 221.

Furthermore, the basic configuration of the contact-type static eliminator 101 is substantially similar to that in exemplary embodiment 1, but the static elimination power source 115 is configured such that a positive direct-current power source 115*a* and a negative direct-current power source 115*b* are provided in parallel and are selectively switched by a changeover switch 250.

Also, the control device 240 is configured such that the positive direct-current power source 115*a* and the negative direct-current power source 115*b* of the static elimination power source 115 are selectively switched by the changeover switch 250, taking into consideration whether or not the medium S has been inverted by the medium inverting mechanism 89 within the image forming unit 210.

It should be noted that, substantially similar to exemplary embodiment 1, the control device 240 is configured such that static elimination bias control (control corresponding to the front surface potential of the medium S) for the contact-type static eliminator 101 and static elimination bias control for the non-contact-type static eliminator 102 are carried out.

In the present example, the static elimination device 100 is installed downstream in the transport direction of the medium S from the medium inverting mechanism 89 within the image forming unit 210, and therefore the positive direct-current power source 115*a* and the negative direct-current power source 115*b* of the static elimination power source 115 are selectively switched according to whether or not the medium S has been inverted.

Figure 22A:
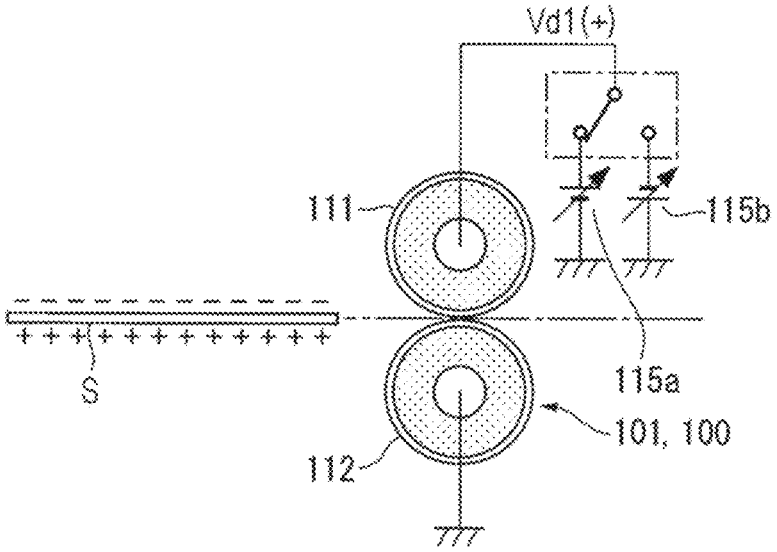
FIG. 22A is an explanatory diagram depicting an example of a static elimination operation carried out by a contact-type static eliminator when a medium is not inverted.

For example, as depicted in FIG. 22A, in a case where the medium S enters the static elimination unit 220 without passing through the medium inverting mechanism 89, the control device 240 selectively switches to the positive direct-current power source 115*a* as the static elimination power source 115. Therefore, the front surface charge of the medium S is appropriately eliminated by the static elimination bias Vd1 produced by the static elimination power source 115 (using the positive direct-current power source 115*a*).

Figure 22B:
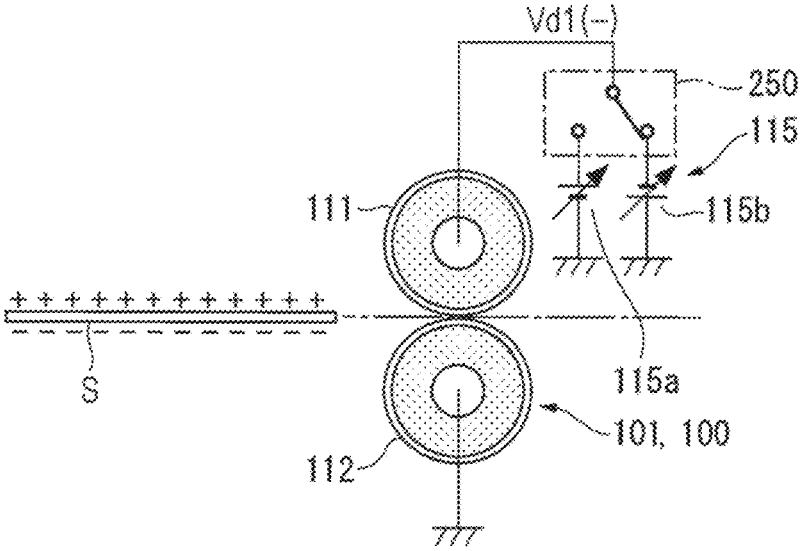
FIG. 22B is an explanatory diagram depicting an example of a static elimination operation carried out by a contact-type static eliminator when the medium is inverted.

On the other hand, as depicted in FIG. 22B, assuming that the medium S passes through the medium inverting mechanism 89 and enters into the static elimination unit 220 in an inverted state, the control device 240 selectively switches to the negative direct-current power source 115*b* as the static elimination power source 115. Therefore, the front surface charge of the medium S is appropriately eliminated by the static elimination bias Vd1 produced by the static elimination power source 115 (using the negative direct-current power source 115*b*).

In the present example, the polarity of the static elimination power source 115 is switched according to whether the medium S has been inverted, but it should be noted that the present disclosure is not restricted thereto. For example, it is also possible for static elimination by the static elimination device 100 to not be carried out when the medium S has been inverted by the medium inverting mechanism 89. Furthermore, a configuration may be adopted in which static elimination processing by the static elimination device 100 cannot be selected on a UI (user interface) when the medium S has been inverted by the medium inverting mechanism 89.

Modified Exemplary Embodiment 1

Figure 23A:
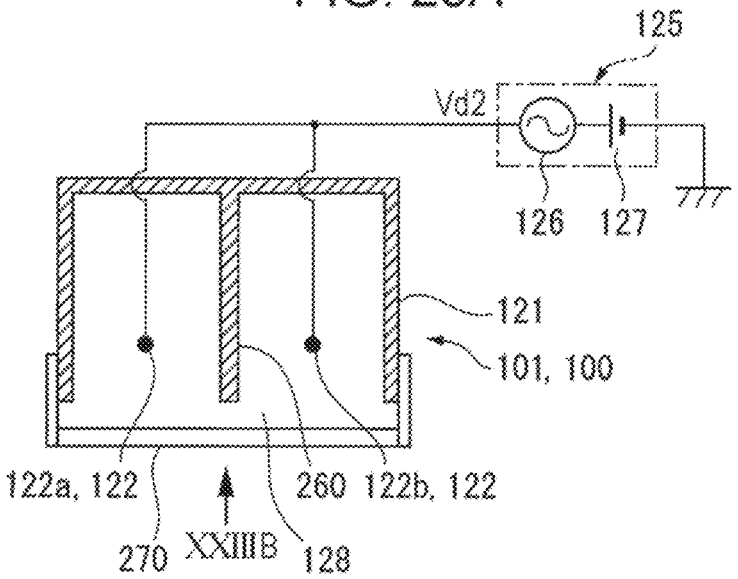
FIG. 23A is an explanatory diagram depicting a section of a non-contact-type static eliminator in modified exemplary embodiment 1.

FIG. 23A depicts a modified exemplary embodiment of the non-contact-type static eliminator 102.

In the drawing, in the basic configuration of the non-contact-type static eliminator 102, the interior of the static elimination housing 121 is partitioned into two chambers by a partitioning member 260, a discharge wire 122 (122*a* and 122*b* in the present example) is installed in each chamber, and the static elimination bias Vd2 including an alternating-current voltage component is applied from the static elimination power source 125 (provided with the alternating-current power source 126 and the direct-current power source 127) to each discharge wire 122.

Figure 23B:
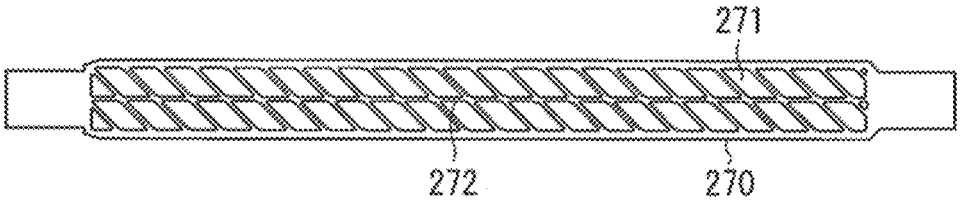
FIG. 23B is an explanatory diagram depicting an example of a shield seen from direction XXIIIB in FIG. 23A.

In addition, in the present example, as depicted in FIGS. 23A and 23B, a plate-like shielding member 270 is provided so as to block the opening 128 in the static elimination housing 121, and through-holes 271 are provided in the shielding member 270.

Figure 23C:
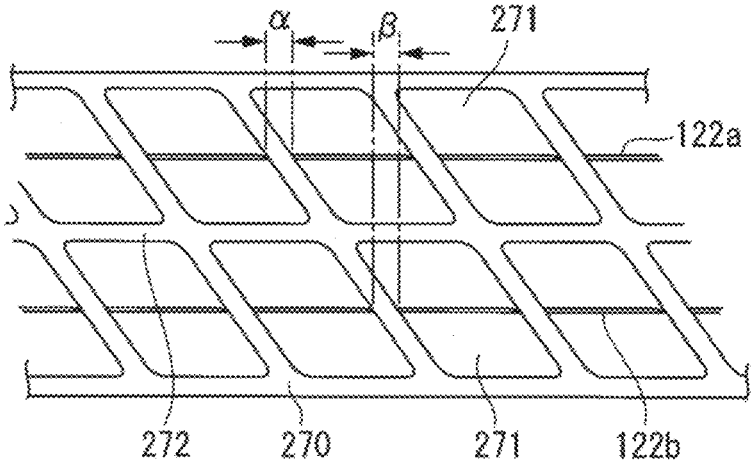
FIG. 23C is an explanatory diagram depicting the action of the shield.

In particular, in the present example, a mode is adopted in which the two discharge wires 122 (122*a* and 122*b*) extend in the width direction intersecting the transport direction of the medium S; however, the through-holes 271 in the shielding member 270 intersect the discharge wires 122*a* and 122*b* in an oblique direction, and are arranged at predetermined intervals in the length direction of the discharge wires 122*a* and 122*b*, as depicted in FIGS. 23B and 23C. Here, it is acceptable for the through-holes 271 to extend continuously so as to extend across the two discharge wires 122*a* and 122*b*; however, in the present example, a partitioning section 272 that halves the through-holes 271 is integrally formed in the shielding member 270 corresponding to the partitioning member 260.

Consequently, in the present exemplary embodiment, at least one of the discharge wires 122*a* and 122*b* is exposed in an arbitrary region in the longitudinal direction. For example, in FIG. 23C, one discharge wire 122*a* is shielded by the shielding member 270 in an arbitrary location in the longitudinal direction (region α, for example), but the other discharge wire 122*b* is exposed facing a through-hole 271 in the shielding member 270 in the arbitrary location in the longitudinal direction (region α, for example). Furthermore, the other discharge wire 122*b* is shielded by the shielding member 270 in an arbitrary location in the longitudinal direction (region β, for example), but the aforementioned one discharge wire 122*a* is arranged in an exposed location facing a through-hole 271 in the arbitrary location in the longitudinal direction (region β, for example).

In this way, in the present example, a mode is adopted in which at least one of the discharge wires 122*a* and 122*b* is exposed in an arbitrary region in the longitudinal direction, and there is no concern of the static elimination processing carried out between the discharge wires 122 and the medium S being interrupted midway along the discharge wires 122*a* and 122*b*.

In addition, in the present example, the shielding member 270 is configured of an insulating material, which is desirable in that ions generated by the discharge wires 122*a* and 122*b* do not leak unnecessarily at the shielding member 270 side. A resin such as a polycarbonate can be used as a material for the shielding member 270.

Modified Exemplary Embodiment 2

Figure 24A:
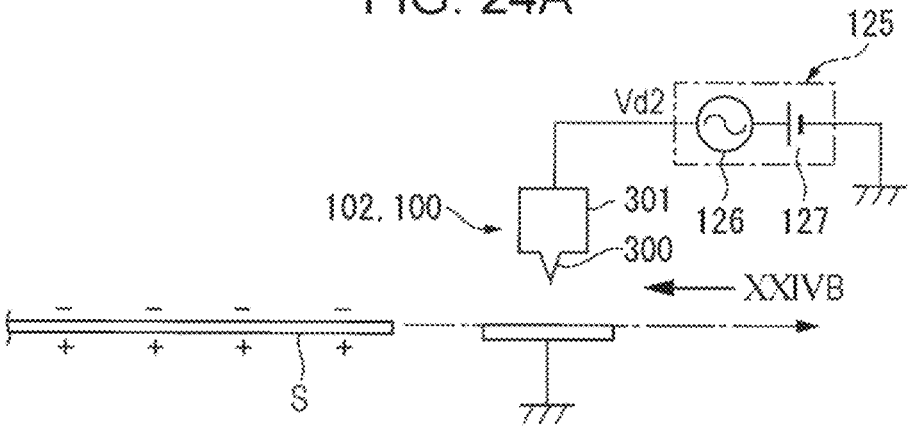
FIG. 24A is an explanatory diagram depicting a section of a non-contact-type static eliminator in modified exemplary embodiment 2.

FIG. 24A depicts the non-contact-type static eliminator 102 according to modified exemplary embodiment 2.

In the drawing, the non-contact-type static eliminator 102 uses a needle-like electrode 300 instead of the discharge wire 122 that is a linear electrode used in exemplary embodiments 1 and 2 and modified exemplary embodiment 1.

Figure 24B:
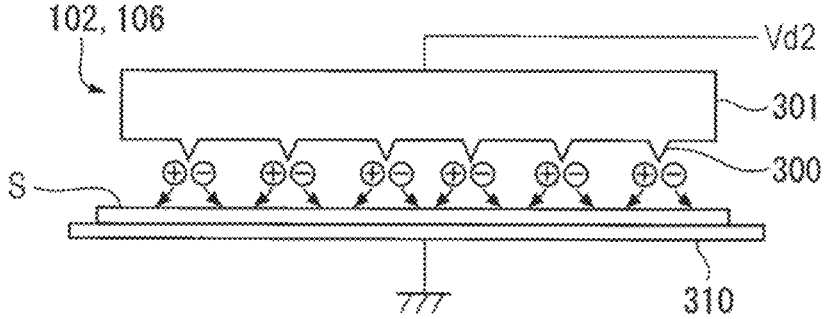
FIG. 24B is a diagram depicting the non-contact-type static eliminator seen from the direction of arrow XXIVB in FIG. 24A.

In the present example, as depicted in FIGS. 24A and 24B, a needle-like electrode 300 is provided at each predetermined interval on a long conductive support member 301 extending in the width direction of the medium S, the static elimination bias Vd2 from the static elimination power source 125 (provided with the alternating-current power source 126 and the direct-current power source 127) is applied to the support member 301, positive ions (+) and negative ions (−) are generated at the periphery of the needle-like electrodes 300, an earth electrode 310 serving as an opposing electrode that opposes the needle-like electrodes 300 is installed at the medium S side, positive and negative ions generated at the periphery of the needle-like electrodes 300 are drawn toward the front surface charge portion of the medium S, and the front surface charge of the medium S is eliminated.

Figure 24C:
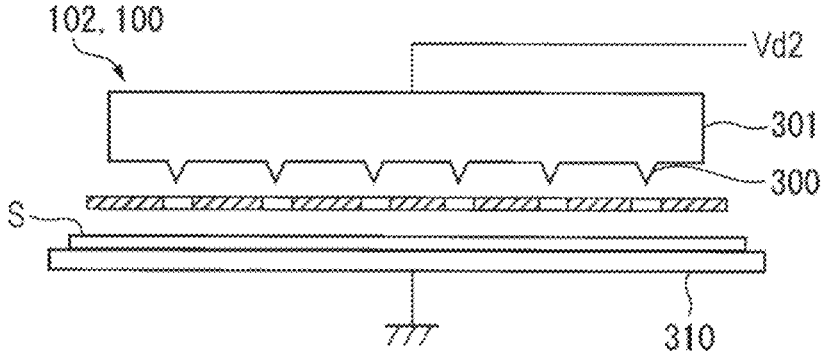
FIG. 24C is an explanatory diagram depicting a modified example of the non-contact-type static eliminator depicted in FIG. 24B.

It should be noted that it is acceptable for the number of needle-like electrodes 300 installed to be selected as appropriate such that it becomes possible for the static elimination operation to be performed across the entire medium S in the width direction, and, as depicted in FIG. 24C, a configuration may be adopted in which the shielding member 270 is installed between the needle-like electrodes 300 and the medium S, through-holes 271 are provided only in locations corresponding to the needle-like electrodes 300, and the discharge operation performed by the needle-like electrodes 300 is ensured while preventing the medium S from being touched by the needle-like electrodes 300.

Examples

Example 1

In example 1, the static elimination device 100 (the contact-type static eliminator 101 and the non-contact-type static eliminator 102) according to exemplary embodiment 1 is used, and the static elimination state brought about by the contact-type static eliminator 101 and the static elimination state brought about by the non-contact-type static eliminator 102 are visualized and evaluated.

Figure 25A:
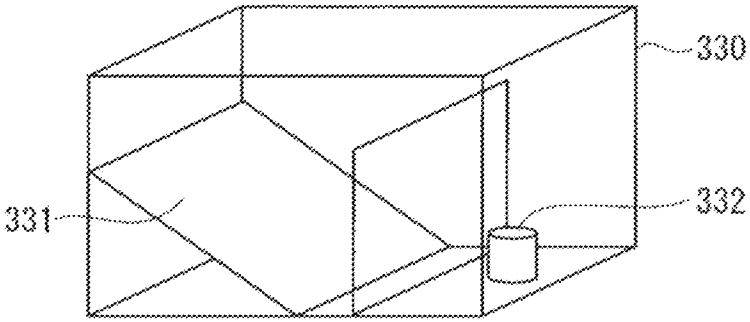
FIG. 25A is an explanatory diagram depicting a cascade development method with which the front surface charge distribution of a medium is visualized in example 1.

FIG. 25A depicts an example in which negatively charged toner (M: magenta) and positively charged toner (C: cyan) are sprayed onto the medium S, and the charge distribution (electrostatic pattern) on the medium S is visualized.

In the drawing, reference number 330 indicates a toner spray chamber, and it is sufficient for grounded sheet metal 331 to be installed inside the spray chamber 330, a medium S such as a resin film to be laid on the sheet metal 331, air to be sprayed toward the toner inside a mesh container 332 installed inside the spray chamber 330, and a toner cloud state to be produced inside the spray chamber 330. With this configuration, toner in the form of a cloud is drawn to the charge on the front surface of the medium S and the toner adheres thereto, which leads to visualization.

Figure 25B:
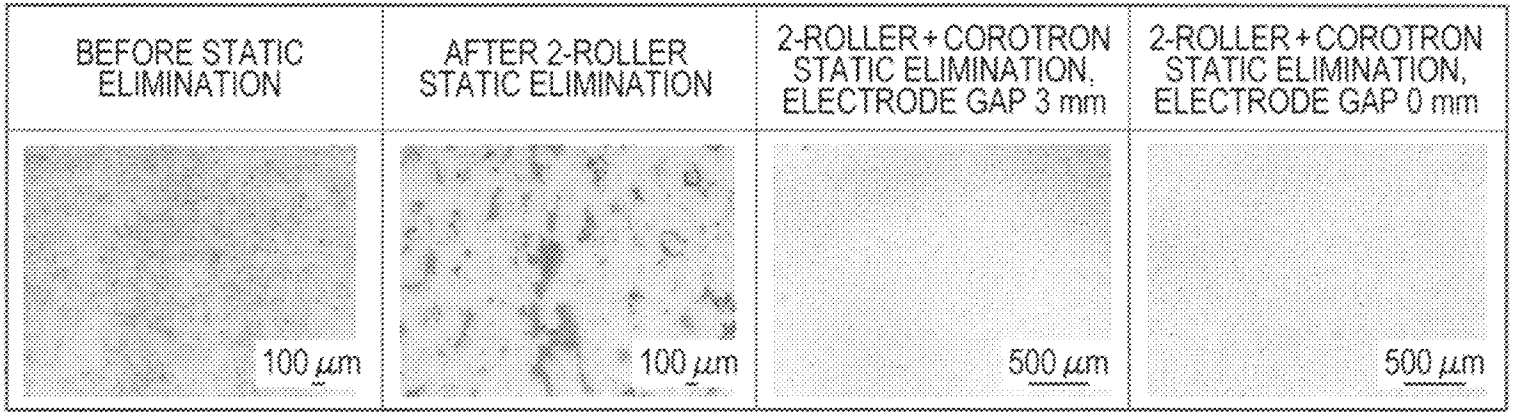
FIG. 25B is an explanatory diagram depicting an example where the front surface charge distribution of the medium before static elimination, the front surface charge distribution of the medium after passing through the contact-type static eliminator, and the front surface charge distribution of the medium after passing through the non-contact-type static eliminator are visualized using the cascade development method.

FIG. 25B depicts, in order from left to right, a visualization of the medium S before static elimination, a visualization of the medium S after static elimination by the contact-type static eliminator 101 (after two-roller static elimination), a visualization of the medium S after static elimination by the contact-type static eliminator 101 and static elimination by the non-contact-type static eliminator 102 (corotron static elimination, electrode gap 3 mm), and a visualization of the medium S after static elimination by the contact-type static eliminator 101 and static elimination by the non-contact-type static eliminator 102 (corotron static elimination, electrode gap 0 mm).

As can be confirmed from FIG. 25B, before static elimination, negative charge on the front surface of the medium S is present in a uniform manner, whereas after static elimination by the contact-type static eliminator 101, although the majority of the negative charge has been eliminated, the negative charge is present as non-uniform clusters compared to before static elimination, and positive charge is generated in regions that are small compared to the negative charge. In contrast, it is apparent that, after static elimination by the non-contact-type static eliminator 102, the front surface charge of the medium S has been mostly eliminated.

Example 2

Figure 26A:
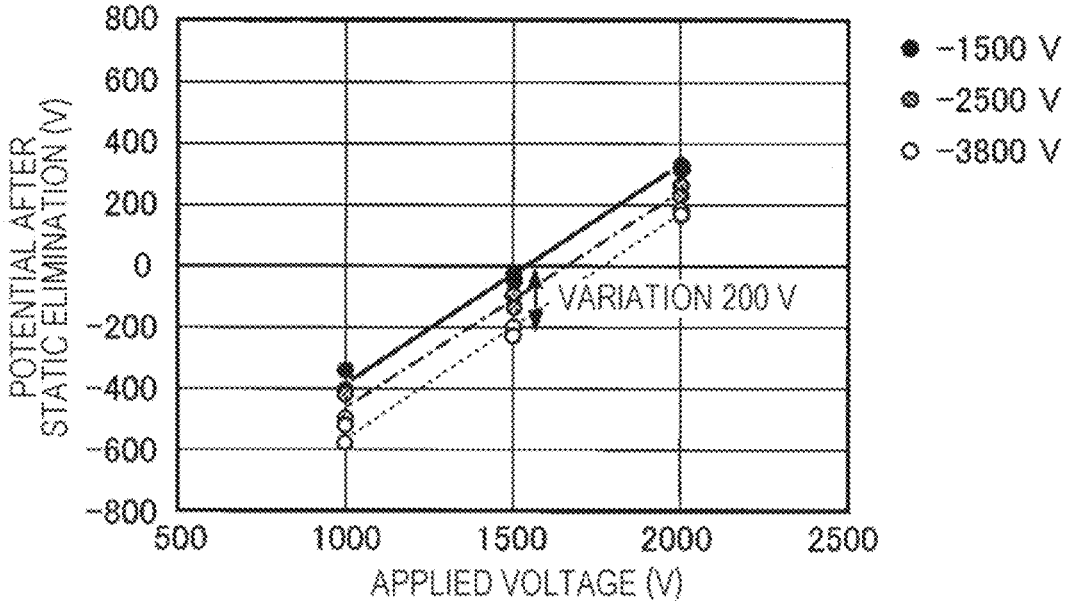
FIG. 26A is a graph diagram depicting the relationship between the applied voltage and the potential after static elimination according to constant voltage control in a contact-type static eliminator according to example 2.

FIG. 26A depicts the relationship between the applied voltage and the potential after static elimination in a case where the contact-type static eliminator 101 is subjected to constant voltage control.

Figure 26B:
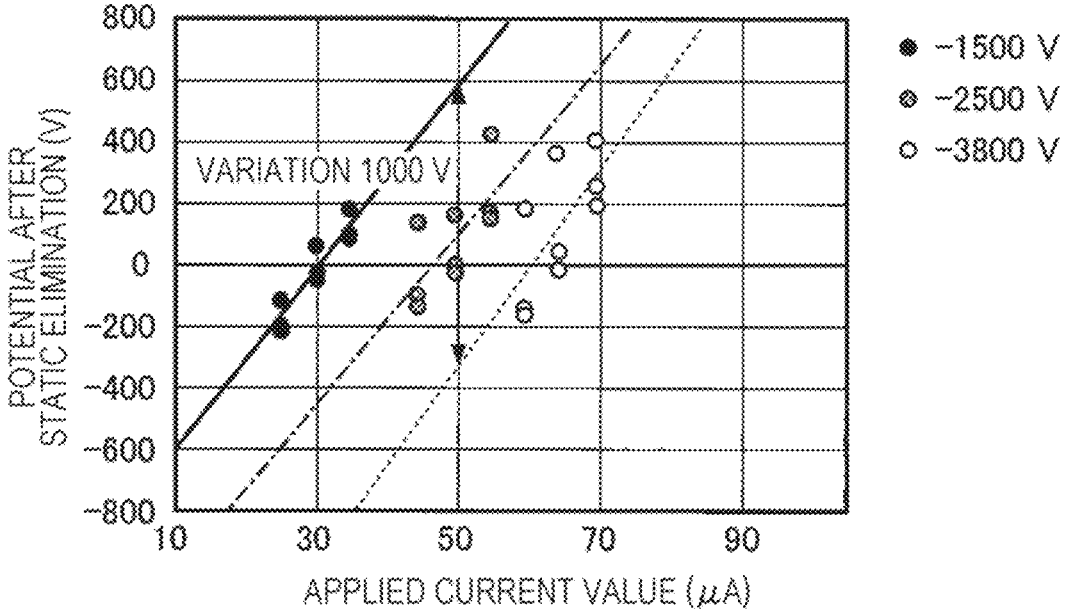
FIG. 26B is a graph diagram depicting the relationship between the applied current and the potential after static elimination according to constant current control in the contact-type static eliminator in example 2.

FIG. 26B depicts the relationship between the applied current value and the potential after static elimination in a case where the contact-type static eliminator 101 is subjected to constant current control.

Test conditions are as follows:

Environment: 22 degrees 55%

Medium: PET film, 100 μm, A3 size

Medium transport speed: 546 mm/s

Second transfer voltage: −3 kV

Static elimination roller at medium front-surface side: Asker C 65 degrees, diameter 20 mm, volume resistivity $10^{6.5}$ Ω·cm Static elimination roller at medium rear-surface side: Asker C 75 degrees, diameter 24 mm, volume resistivity $10^{7}$ Ω·cm In the constant voltage control in FIG. 26A, discharging stops when less than or equal to the discharge starting voltage, and therefore the front surface potential after static elimination converges in a certain range regardless of the input front surface potential.

In contrast, in the constant current control in FIG. 26B, there is no change in the current value even if the roller resistance changes over time or due to a temperature increase, and therefore there is resilience to system resistance fluctuations, but because a constant charge amount is supplied to the medium S, there is a risk of variation in the front surface potential after static elimination due to the input front surface potential.

Example 3

Figure 27:
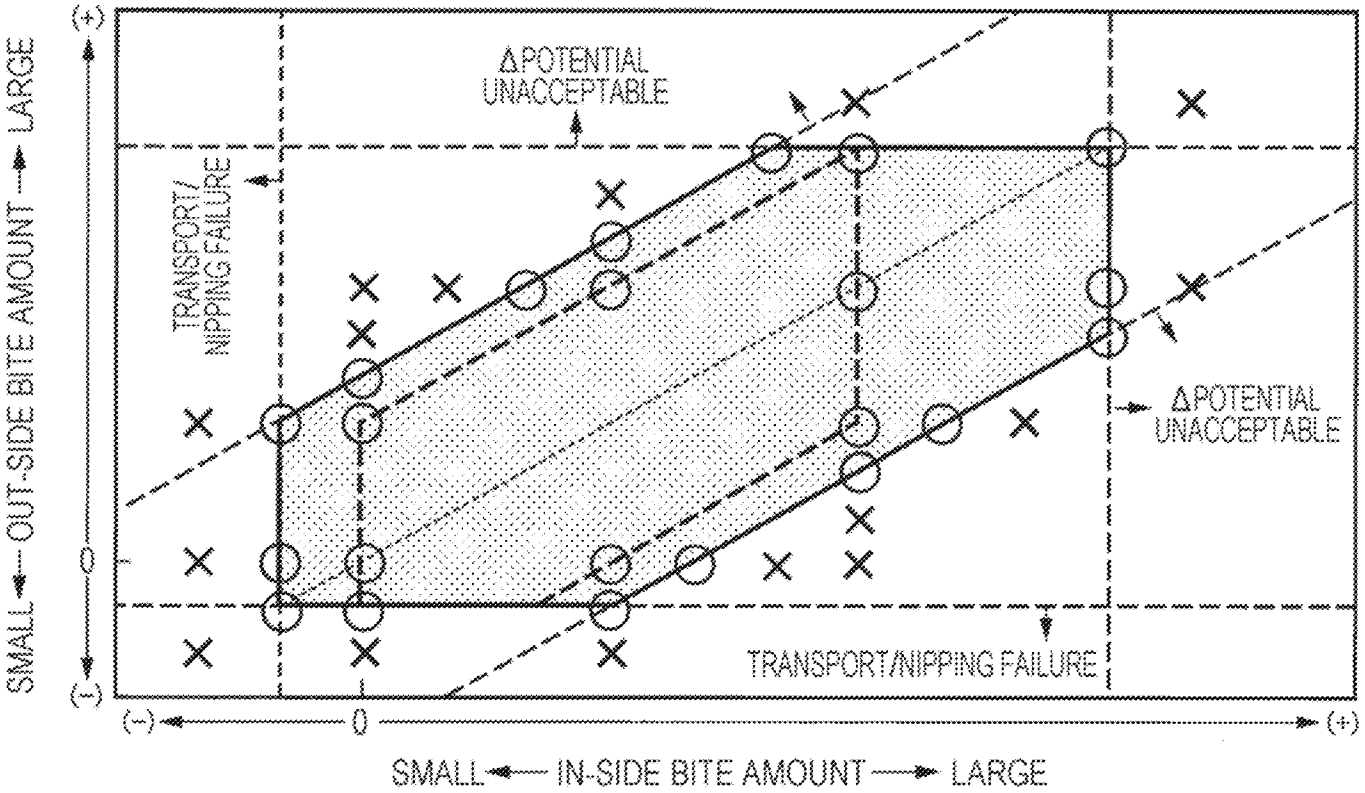
FIG. 27 is an explanatory diagram depicting the relationship between medium nip fluctuation according to static elimination rollers having a paired structure and static elimination control stability in example 3.

FIG. 27 depicts an investigation into the effect of nip fluctuation in the static elimination rollers 111 and 112 having a paired structure according to the contact-type static eliminator 101.

Test conditions are as follows:

Medium transport speed: 182 mm/s

Constant voltage control

Static elimination bias: 1500 V

Static elimination roller at medium front-surface side: Asker C 70 degrees, diameter 20 mm, volume resistivity $10^6$ Ω·cm Static elimination roller at medium rear-surface side: Asker C 75 degrees, diameter 24 mm, volume resistivity $10^7$ Ω·cm In FIG. 27, in-side bite amount means the amount of bite to the opposing static elimination roller at the axial center location of the metal shafts positioned at the front side of the static elimination rollers, and out-side bite amount means the amount of bite to the opposing static elimination roller at the axial center location of the metal shafts positioned at the far side of the static elimination rollers.

In FIG. 27, the ○ symbol means that transportability, nipping, and static elimination operability (Δ potential: static elimination enabling potential) with respect to the medium are satisfactory, and the x symbol means that any of these is unacceptable.

Here, there being a difference in the bite amounts at the in-side and the out-side of the static elimination rollers means that static elimination rollers having a paired structure are arranged at an incline with respect to the axial direction, but since a mode is adopted in which the static elimination rollers have an elastic body, it is confirmed that the transportability, nipping, and static elimination operability with respect to the medium are within a satisfactory range.

Example 4

FIG. 28A depicts the transport speed v of the medium, the frequency f of the static elimination bias Vd2, numerical values for the static elimination parameter f/v, and sticking evaluation results for the medium, in the non-contact-type static eliminator. It should be noted that, from among the evaluation results, "○-" indicates a satisfactory static elimination result, "○" indicates a static elimination result that is further satisfactory compared to "○-", and "x" indicates that the static elimination result is insufficient.

FIG. 28B is an explanatory diagram depicting the relationship between the frequency serving as a static elimination parameter and other parameters when a satisfactory static elimination result is obtained, FIG. 28C is an explanatory diagram depicting the relationship between the static elimination parameter f/v and other parameters when a satisfactory static elimination result is obtained, and FIG. 28D is an explanatory diagram depicting the relationship between a static elimination parameter f/v*L (L being the opening width in the static elimination housing) and other parameters when a satisfactory static elimination result is obtained.

Figure 29A:
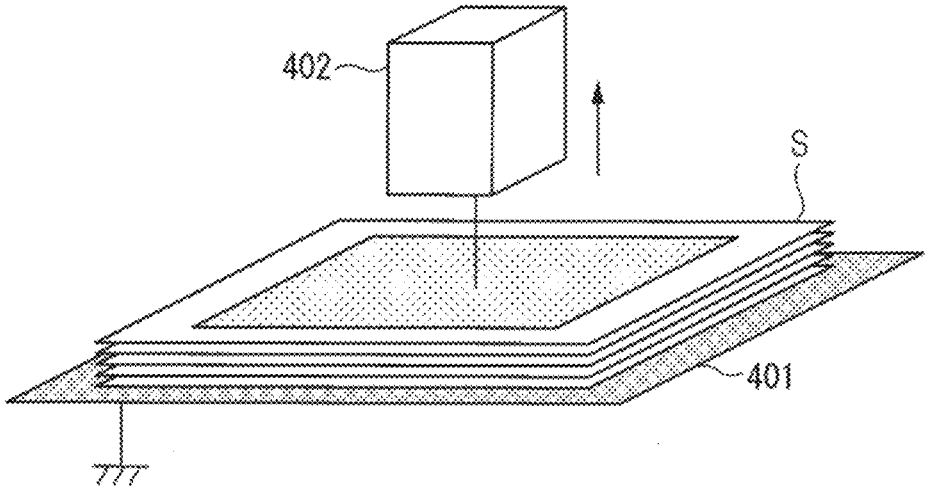
FIG. 29A is an explanatory diagram depicting an evaluation method in example 4.

FIG. 29A depicts an example of a method for evaluating sticking of the medium in the present example.

In the drawing, five mediums S made up of resin films are stacked, the lower four films are fixed to sheet metal 401, static elimination is carried out, and the mediums S are left for 24 h, after which a jig 402 is mounted on the uppermost medium S, the degree to which the medium S sticks thereto is measured, and an evaluation is carried out based on the measurement value therefor.

Figure 29B:
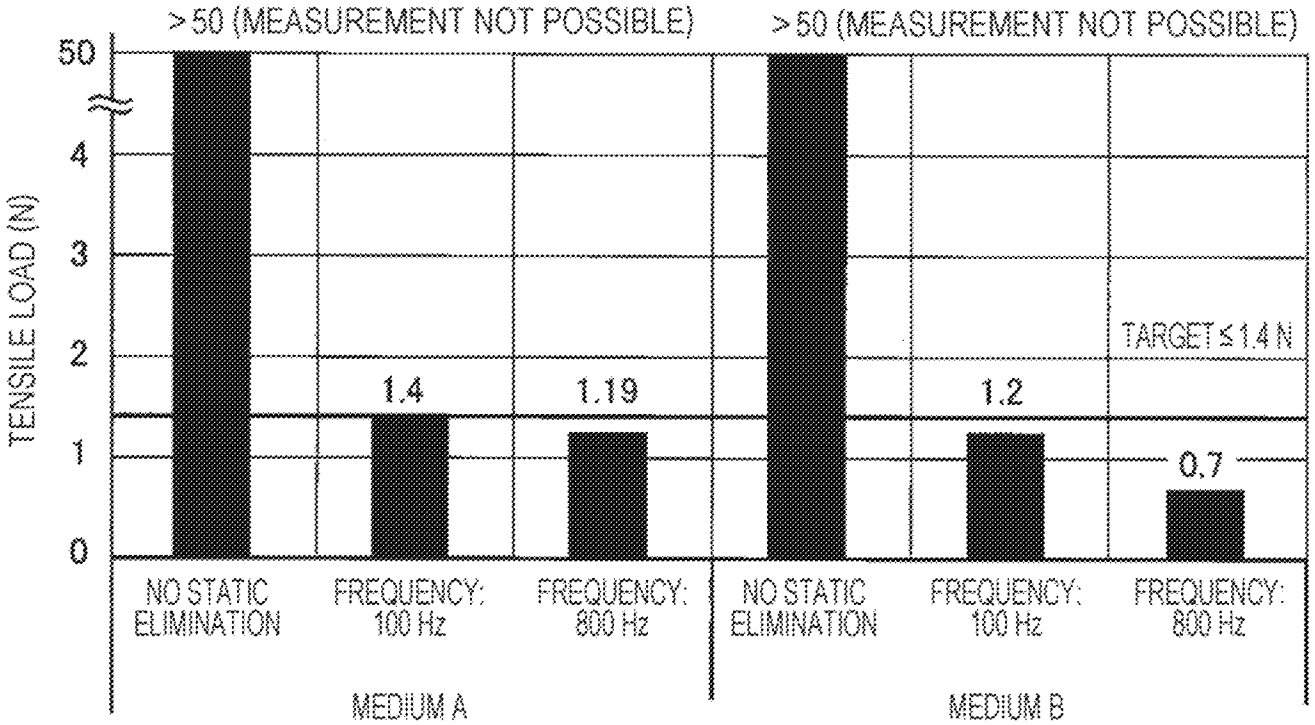
FIG. 29B is an explanatory diagram depicting the relationship between frequency and tensile load in the evaluation method of FIG. 29A.

Here, when looking at the relationship between frequency and tensile load, the results depicted in FIG. 29B are obtained.

When a medium sticking evaluation was carried out using medium A (OZK 100 made by Heiwa Paper Co., Ltd.) and medium B (OZK 188 made by Heiwa Paper Co., Ltd.) under the condition where static elimination was not carried out, and also under the condition where static elimination was carried out with the frequency f being changed to 100 Hz and 800 Hz, although measurement was not possible under the condition where static elimination was not carried out, when static elimination was carried out with the frequency being appropriately selected, the medium sticking evaluation was satisfactory for both mediums A and B in that the target tensile load or less was reached. It should be noted that the target for the tensile load is determined as 1.4 N because it has been confirmed that, as long as the target level or less is achieved, it is easy for a medium to be transported to a post-processing device by a general medium transport roller after the medium has been stacked on the medium output receiver 86.

According to FIGS. 28A to 28D, it is apparent that the following are satisfactory.

$$f/v \geq 0.8 \quad \text{(expression 1)}$$

$$f/v \geq 1.5 \quad \text{(expression 2)}$$

$$f/v*L \geq 30 \quad \text{(expression 3)}$$

Example 5

Figure 30A:
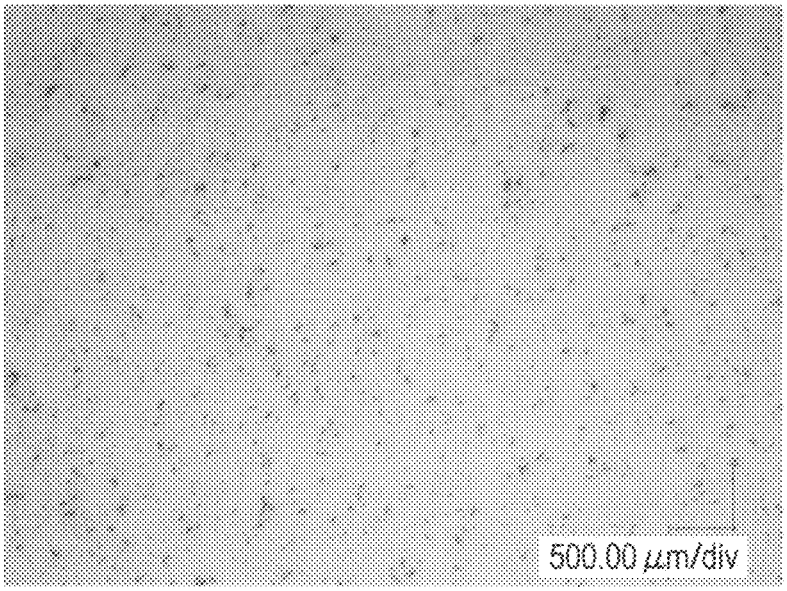
FIG. 30A is an explanatory diagram depicting an example of the front surface charge distribution of a medium after static elimination in a case where the static elimination parameter f (frequency)/v (medium transport speed) is greater than or equal to a specified value in a non-contact-type static eliminator according to example 5.

FIG. 30A is an explanatory diagram depicting a static elimination effect for a medium in a case where the static elimination parameter f/v is greater than or equal to a specified value, using the non-contact-type static eliminator.

Figure 30B:
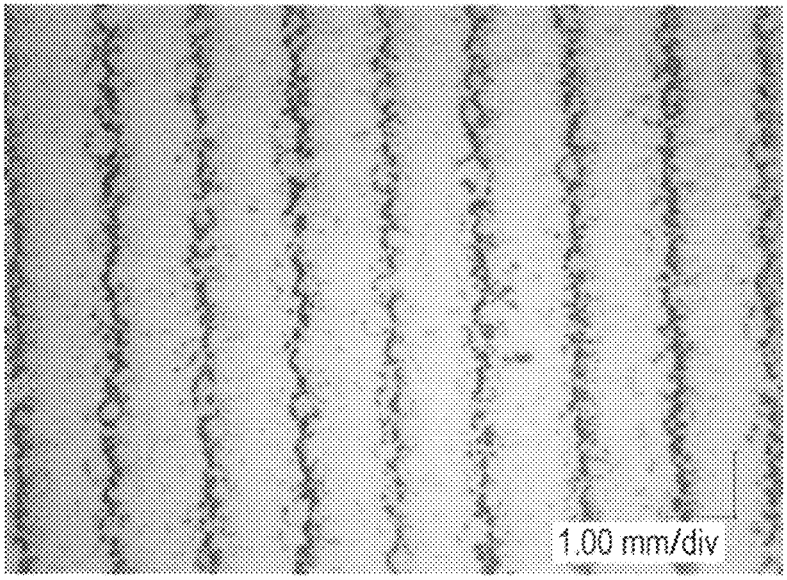
FIG. 30B is an explanatory diagram depicting an example of the front surface charge distribution of the medium after static elimination in a case where the static elimination parameter f/v is less than the specified value.

FIG. 30B is an explanatory diagram depicting a static elimination effect for a medium in a case where the static elimination parameter f/v is less than the specified value, using the non-contact-type static eliminator.

In either case, the charged state of the medium is visualized using the method used in example 1.

According to FIG. 30B, it is apparent that residual charge remains in each ion generation period when the static elimination parameter f/v is less than the specified value. In contrast, if the static elimination parameter f/v is greater than or equal to the specified value, it is apparent that static is eliminated with there being hardly any residual charge on the medium.

Example 6

Figure 31:
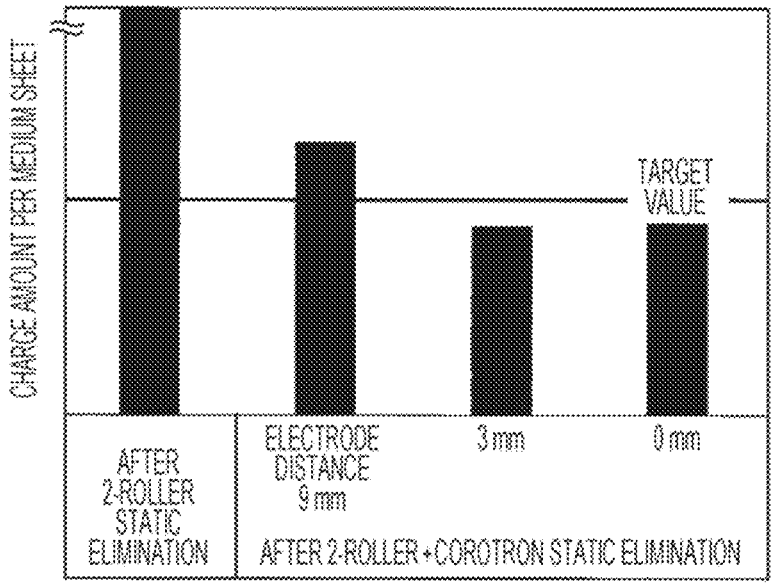
FIG. 31 is an explanatory diagram depicting the relationship between electrode distance (corresponding to the distance between a discharge wire and a medium) and a charge amount (corresponding to the front surface charge amount of the medium) in a non-contact-type static eliminator according to example 6.

FIG. 31 depicts an inspection of the static elimination effect according to electrode distance (the distance between the discharge wire and the medium) in the non-contact-type static eliminator.

In FIG. 31, the "after two-roller static elimination" section indicates the charged state of the medium after having passed through the contact-type static eliminator, and indicates that there still remains a large charging amount per sheet.

Thereafter, when static elimination by the non-contact-type static eliminator is carried out with the electrode distance being changed, it is apparent that the static elimination effect brought about by the non-contact-type static eliminator is satisfactory as long as the electrode distance is within 3 mm. It should be noted that, in an example in which the electrode distance is 9 mm, it is apparent that the region between the discharge wire and the medium is too wide and the static elimination effect brought about by the non-contact-type static eliminator is insufficient.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A static elimination device comprising:

a first static elimination member configured to contact a medium that is transported;

a second static elimination member configured such that the medium may be inserted between the first static elimination member and the second static elimination member; and a power source configured to apply a voltage to at least one of the first static elimination member and the second static elimination member, wherein at least one of the first static elimination member and the second static elimination member has an elastic body, wherein the static elimination device is configured such that the medium may be subjected to static elimination in such a way that a distribution between positive charge and negative charge on a front surface of the medium after static elimination becomes non-uniform compared to before static elimination, and wherein the static elimination device is configured such that the medium may be subjected to static elimination in such a way that in the distribution of front surface charge after static elimination there is an increase in a proportion of charge that was dominant before static elimination.

2. The static elimination device according to claim 1, wherein the first static elimination member and the second static elimination member both have the elastic body.

3. The static elimination device according to claim 1, wherein, in at least one of the first static elimination member and the second static elimination member, a surface that makes contact with the medium has a curved surface section.

4. The static elimination device according to claim 2, wherein, in at least one of the first static elimination member and the second static elimination member, a surface that makes contact with the medium has a curved surface section.

5. The static elimination device according to claim 3, wherein at least one of the first static elimination member and the second static elimination member is a rotating member.

6. The static elimination device according to claim 4, wherein at least one of the first static elimination member and the second static elimination member is a rotating member.

7. The static elimination device according to claim 2, wherein the medium is subjected to static elimination in such a way that a distribution between positive charge and negative charge on a front surface of the medium after static elimination becomes non-uniform compared to before static elimination.

8. The static elimination device according to claim 3, wherein the medium is subjected to static elimination in such a way that a distribution between positive charge and negative charge on a front surface of the medium after static elimination becomes non-uniform compared to before static elimination.

9. The static elimination device according to claim 1, further comprising a controller that controls an applied voltage of the power source in accordance with at least one front surface potential from before and after static is eliminated from the medium.

10. The static elimination device according to claim 9, wherein the controller controls the applied voltage of the power source in accordance with the at least one front surface potential from before static is eliminated from the medium.

11. The static elimination device according to claim 9, wherein the controller controls the applied voltage of the power source in accordance with the at least one front surface potential from after static is eliminated from the medium.

12. The static elimination device according to claim 1, wherein the static elimination member having the elastic body has an Asker C hardness that is greater than or equal to approximately 60 degrees and less than or equal to approximately 80 degrees.

13. The static elimination device according to claim 1, wherein the static elimination member having the elastic body has a volume resistivity that is greater than or equal to approximately $10^6$ Ω·cm and less than or equal to approximately $10^8$ Ω·cm.

14. A medium processing device comprising:

a transporter that transports a medium;

a charger that is provided midway along a transport path of the medium, and charges the medium; and the static elimination device according to claim 1, which is provided further downstream in a transport direction of the medium than the charger, and eliminates static from the medium charged by the charger.

15. The medium processing device according to claim 14, wherein the charger is a transfer unit that transfers an image with the medium being inserted between transfer members having a paired structure, and a medium contact pressure between the first and second static elimination members constituting the static elimination device is set to be lower than a medium contact pressure between the transfer members having the paired structure.

16. The medium processing device according to claim 14, further comprising:

a medium inverter further upstream in the transport direction of the medium than the static elimination device, and a switching unit that switches a polarity of the applied voltage of the power source in accordance with whether or not the medium is inverted by the medium inverter.

* * * * *